US011756501B2

(12) United States Patent
Tsuchi

(10) Patent No.: US 11,756,501 B2
(45) Date of Patent: Sep. 12, 2023

(54) DISPLAY APPARATUS OUTPUT CIRCUIT SELECTIVELY PROVIDING POSITIVE AND NEGATIVE VOLTAGES REALIZED IN REDUCED AREA IN A SIMPLE CONFIGURATION

(71) Applicant: LAPIS Technology Co., Ltd., Yokohama (JP)

(72) Inventor: Hiroshi Tsuchi, Yokohama (JP)

(73) Assignee: LAPIS Technology Co., Ltd., Yokohama (JP)

( * ) Notice: Subject to any disclaimer, the term of this patent is extended or adjusted under 35 U.S.C. 154(b) by 0 days.

(21) Appl. No.: 17/672,655

(22) Filed: Feb. 15, 2022

(65) Prior Publication Data

US 2022/0277704 A1 Sep. 1, 2022

(30) Foreign Application Priority Data

Feb. 26, 2021 (JP) ..... 2021-029568

(51) Int. Cl.
*G09G 3/36* (2006.01)

(52) U.S. Cl.
CPC ..... *G09G 3/3696* (2013.01); *G09G 3/3688* (2013.01); *G09G 2310/0254* (2013.01); *G09G 2310/0272* (2013.01)

(58) Field of Classification Search
CPC ..... G09G 3/36; G09G 3/3611; G09G 3/3614; G09G 3/3622; G09G 3/3625; G09G 3/364; G09G 3/3644; G09G 3/3648; G09G 3/3666; G09G 3/3674; G09G 3/3677; G09G 3/3681; G09G 3/3685; G09G 3/3688; G09G 3/3692; G09G 3/3696
USPC ..... 345/87–104
See application file for complete search history.

(56) References Cited

U.S. PATENT DOCUMENTS

| | | | | |
|---|---|---|---|---|
| 11,281,034 | B2 * | 3/2022 | Tsuchi | G02F 1/13306 |
| 11,568,831 | B2 * | 1/2023 | Tsuchi | G09G 3/3685 |
| 2003/0201959 | A1 * | 10/2003 | Sakaguchi | G09G 3/3696 345/87 |
| 2008/0089003 | A1 * | 4/2008 | Kojima | G09G 3/20 361/246 |
| 2010/0328289 | A1 * | 12/2010 | Enrin | H04N 5/70 345/87 |

(Continued)

FOREIGN PATENT DOCUMENTS

JP 2008102211 5/2008

*Primary Examiner* — Amit Chatly
*Assistant Examiner* — Nelson Lam
(74) *Attorney, Agent, or Firm* — JCIPRNET

(57) ABSTRACT

An output circuit includes a first switch that outputs a positive voltage signal received via a first node when in an ON state, a second switch that outputs a negative voltage signal received via a second node when in an ON state, third and fourth switches that set the first and second nodes to a reference power supply voltage when in an ON state, a first voltage follower circuit that supplies a voltage obtained by shifting a voltage of the positive voltage signal supplied to the first node to a negative side by a predetermined voltage difference to a gate of the first switch, and a second voltage follower circuit that supplies a voltage obtained by shifting a voltage of the negative voltage signal supplied to the second node to a positive side by a predetermined voltage difference to a gate of the second switch.

20 Claims, 12 Drawing Sheets

(56) References Cited

U.S. PATENT DOCUMENTS

| | | | | |
|---|---|---|---|---|
| 2015/0194115 | A1* | 7/2015 | Tsuchi | G09G 3/3258<br>345/212 |
| 2017/0025081 | A1* | 1/2017 | Satoh | G09G 3/006 |
| 2018/0366077 | A1* | 12/2018 | Higuchi | H03F 3/45269 |
| 2021/0231992 | A1* | 7/2021 | Tsuchi | G09G 3/3688 |
| 2022/0171227 | A1* | 6/2022 | Tsuchi | G09G 3/3688 |
| 2022/0270563 | A1* | 8/2022 | Tsuchi | G09G 3/3685 |

* cited by examiner

DISPLAY APPARATUS OUTPUT CIRCUIT SELECTIVELY PROVIDING POSITIVE AND NEGATIVE VOLTAGES REALIZED IN REDUCED AREA IN A SIMPLE CONFIGURATION

CROSS-REFERENCE TO RELATED APPLICATION

This application claims the priority benefit of Japan application serial no. 2021-029568, filed on Feb. 26, 2021. The entirety of the above-mentioned patent application is hereby incorporated by reference herein and made a part of this specification.

BACKGROUND

Technical Field

The present disclosure relates to an output circuit that outputs positive and negative voltages, a data driver that drives a display panel, and a display apparatus.

Related Art

Liquid crystal display apparatuses in which an active matrix drive type liquid crystal panel is used for a display device have become generally known as a main type of display apparatuses in recent years.

A liquid crystal panel includes a plurality of data lines each extending in the vertical direction of the two-dimensional screen and a plurality of gate lines each extending in the horizontal direction of the two-dimensional screen, the data lines and gate lines being disposed to intersect each other. Furthermore, a pixel part connected to a data line and a gate line is formed at each of the intersection parts of the plurality of data lines and the plurality of gate lines.

A liquid crystal display apparatus includes a data driver that supplies a gradation data signal having an analog voltage value corresponding to the luminance level of each pixel to the data lines at a data pulse in units of one horizontal scanning period, together with such a liquid crystal panel.

The data driver performs polarity inversion driving to supply a positive gradation data signal and a negative gradation data signal in an alternating manner to the liquid crystal panel in every predetermined frame period in order to prevent degradation of the liquid crystal panel.

As an output circuit that performs such polarity inversion driving, an output circuit provided with a switch group that receives a positive drive voltage and a negative drive voltage corresponding to gradation data signals, alternately selects one of the voltages, and outputs the selected voltage to the liquid crystal panel has been proposed (e.g., see SW1 to SW12 of FIGS. 8 to 10 of Patent Literature 1: Japanese Patent Application Laid-Open (JP-A) No. 2008-102211).

By using the switches SW1 to SW12, the output circuit described in Patent Literature 1 switches from the state in which a positive drive voltage (5 V) is output from an output pad OUT 1 (the state of FIG. 8 of the same literature) to the state in which a negative drive voltage (−5 V) is output from the output pad OUT 1 (the state of FIG. 10 of the same literature).

Furthermore, by performing the polarity switching as described above, the output circuit described in Patent Literature 1 sets one end of each switch to the state of 0 V first as illustrated in FIG. 9 of the same literature and then switches to the state illustrated in FIG. 10 of the same literature. As a result, a withstanding voltage of each switch can be configured to be a low withstanding voltage that is half of the range of a liquid crystal drive voltage.

In Patent Document 1 (FIGS. 8 to 10 of the same literature), although output selection switches (SW5 to SW8) connected to OUT1 and OUT2 have withstanding voltages at both ends with respect to elements with a low-withstanding voltage that is half of the range of a liquid crystal drive voltage, in a case in which the switches are configured to be transistor switches with a low withstanding voltage that is half of the range of a liquid crystal drive voltage, they need to be configured as single conductive transistor switches, because complementary switches in which P channel type switches and N channel type switches are combined are not suitable for use.

The reasons for this will be given below.

For example, it may be assumed that a range of a positive drive voltage value is VGND (0 V) to VDDH (5 V), and a range of a negative drive voltage value is VDDL (−5 V) to VGND (0 V). Here, a case in which the output selection switch SW5 that outputs a positive drive voltage disclosed in Patent Literature 1 (FIGS. 8 to 10 of the same literature) is configured as an N-channel transistor switch will be considered. Because the N-channel transistor switch SW5 outputs a positive drive voltage to be supplied to a first terminal, a maximum positive power supply voltage VDDH is supplied to the control terminal. Here, when the output terminal OUT1 connected to the second terminal of the N-channel transistor switch SW5 is driven with the reference power supply voltage VGND due to polarity inversion from negative to positive, if the output terminal OUT1 does not sufficiently approach the reference power supply voltage VGND from a negative drive voltage, there is a risk of a voltage difference between the control terminal of the N-channel transistor switch SW5 and the output terminal OUT1 connected to the second terminal exceeding a withstanding voltage. In order to avoid this risk, it is necessary to secure a sufficient drive time for the reference power supply voltage VGND to the output terminal OUT1 at the time of polarity inversion, but high-speed driving under operation conditions with a short output period is difficult.

In addition, in a case in which a positive drive voltage value is close to the positive power supply voltage VDDH, even if the positive power supply voltage VDDH is supplied to the control terminal of the N-channel transistor switch SW5, it is not possible to output a voltage in the range from the positive power supply voltage VDDH to the threshold voltage of the N-channel transistor.

On the other hand, a case in which the output selection switch SW5 is configured as a P-channel transistor switch may be considered. Because the P-channel transistor switch SW5 outputs a positive drive voltage to be supplied to the first terminal, control is performed such that a voltage within a withstanding voltage which is a lower voltage than the positive drive voltage is supplied to the control terminal. In this case, there is no risk of the voltage difference between the control terminal of the P-channel transistor switch SW5 and the output terminal OUT1 connected to the second terminal exceeding the withstanding voltage. In addition, if a voltage supplied to the control terminal of the P-channel transistor switch SW5 is controlled appropriately for a positive drive voltage, any positive drive voltage can be output from the P-channel transistor switch SW5.

Thus, an output selection switch that outputs a positive drive voltage is optimally configured solely by a P-channel transistor switch. Likewise, an output selection switch that outputs a negative drive voltage is optimally configured solely by an N-channel transistor switch.

However, in the configuration in which an output selection switch is configured by a single conductive transistor switch, although at least control over supply of a negative voltage is needed for the control terminal of the P-channel transistor switch that outputs a positive drive voltage when a positive drive voltage near the reference power supply voltage VGND is output, control across the polarities is not easy. Similarly, control across the polarities for the control terminal of the N-channel transistor that outputs a negative drive voltage is not easy.

SUMMARY

An output circuit according to an embodiment of the present disclosure includes a positive voltage signal supply circuit that supplies a positive voltage signal having a higher voltage than a reference power supply voltage to a first node or cuts off supply of the positive voltage signal to the first node, a negative voltage signal supply circuit that supplies a negative voltage signal having a lower voltage than the reference power supply voltage to a second node or cuts off supply of the negative voltage signal to the second node, a first output terminal, a first switch that is a first P-channel transistor switch with a source connected to the first node and a drain connected to the first output terminal, connects the first output terminal to the first node when in an ON state, and cuts off the connection of the first output terminal to the first node when in an OFF state, a second switch that is a first N-channel transistor switch with a source connected to the second node and a drain connected to the first output terminal, connects the first output terminal to the second node when in an ON state, and cuts off the connection of the first output terminal to the second node when in an OFF state, a third switch that applies the reference power supply voltage to the first node when in an ON state and stops the application of the reference power supply voltage to the first node when in an OFF state, a fourth switch that applies the reference power supply voltage to the second node when in an ON state and stops the application of the reference power supply voltage to the second node when in an OFF state, a first voltage follower circuit that is connected between the first switch and the first node and controls the ON state of the first switch, a second voltage follower circuit that is connected between the second switch and the second node and controls the ON state of the second switch, a first control section that, when active, controls the OFF state of the first switch, and a second control section that, when active, controls the OFF state of the second switch, in which the first voltage follower circuit includes a first load element connected between the source and a gate of the first switch and a first current source having one end connected to the gate of the first switch and the first load element, the first current source generating a current flowing to the first load element, and the first voltage follower circuit supplies a voltage obtained by shifting a voltage of the positive voltage signal supplied to the first node to a negative side by a predetermined voltage difference to the gate of the first switch, and the second voltage follower circuit includes a second load element connected between the source and a gate of the second switch and a second current source having one end connected to the gate of the second switch and the second load element, the second current source generating a current flowing to the second load element, and the second voltage follower circuit supplies a voltage obtained by shifting a voltage of the negative voltage signal supplied to the second node to a positive side by a predetermined voltage difference to the gate of the second switch.

In addition, a data driver according to an embodiment of the present disclosure includes a plurality of the output circuits, and a plurality of gradation voltage signals having a positive or negative voltage value for driving a plurality of data lines of a liquid crystal display panel is output from the plurality of output circuits.

In addition, a display apparatus according to an embodiment of the present disclosure includes a plurality of the output circuits, and a plurality of gradation voltage signals having a positive or negative voltage value is output from the plurality of output circuits.

In the output circuit according to the present disclosure, the first switch (P-channel transistor) receives a positive voltage signal with a voltage higher than the reference power supply voltage via the first node and outputs the positive voltage signal from the output terminal when the first switch is in the ON state. Furthermore, the second switch (N-channel transistor) receives a negative voltage signal with a voltage lower than the reference power supply voltage via the second node and outputs the negative voltage signal from the output terminal when the second switch is in the ON state.

Here, the first and second switches are controlled such that they are in the ON state by the first and second voltage follower circuits having the following configuration.

The first voltage follower circuit includes the first load element connected between the source and the gate of the first switch and the first current source that generates a current which flows to the first load element. The first voltage follower circuit generates a voltage obtained by shifting the voltage of the positive voltage signal supplied to the first node to the negative side by a predetermined voltage difference with the first load element and the first current source and supplies the generated voltage to the gate of the first switch. As a result, even if the voltage value of the positive voltage signal is close to the reference power supply voltage, the first switch can be kept in the ON state.

The second voltage follower circuit includes the second load element connected between the source and the gate of the second switch and the second current source that generates a current which flows to the second load element. The second voltage follower circuit generates a voltage obtained by shifting the voltage of the negative voltage signal supplied to the second node to the positive side by a predetermined voltage difference with the second load element and the second current source and supplies the generated voltage to the gate of the second switch. As a result, even if the voltage value of the negative voltage signal is close to the reference power supply voltage, the second switch can be kept in the ON state.

Furthermore, the output circuit includes the third and fourth switches that set the first and second nodes to the reference power supply voltage individually when the switches are in the ON state, and the first and second control sections that set the first and second switches to be in the OFF states individually when the control sections are in an active state. The first and second control sections set the second switch to be off and the second node to the reference power supply voltage when the positive voltage signal is to be output from the output terminal, and set the first switch to be off and the first node to the reference power supply voltage when the negative voltage signal is to be output from the output terminal.

With the above-described configuration, for each switch that handles the positive voltage signal with a voltage higher than the reference power supply voltage and the negative voltage signal with a voltage lower than the reference power supply voltage, a transistor with a withstanding voltage that is about half of the voltage range from a minimum voltage of the negative voltage signal to a maximum voltage of the positive voltage signal can be used. Furthermore, a simple analog circuit including a load element and a current source that allow a current which flows to the load element, like the above-described first and second voltage follower circuits, can perform control across polarities such that the first and second switches are kept in the ON state.

Therefore, according to the present disclosure, an output circuit that can selectively output one of a positive voltage and a negative voltage, a data driver including the output circuit, and a display apparatus can be realized to have a reduced area in a simple configuration.

DETAILED DESCRIPTION

Embodiments of the present disclosure realize, in an output circuit that drives a capacitive load with positive and negative voltage signals with respect to a reference power supply voltage, to configure an output selection switch that outputs a positive or negative drive voltage to an output terminal to which the capacitive load is connected as a single conductive transistor switch, to simplify a control circuit that controls supply of a voltage to a control terminal of the single conductive transistor switch, and to configure the output circuit as a low-withstanding voltage transistor to reduce the area (cost reduction). In addition, embodiments of the present disclosure provide a configuration of a data driver of a liquid crystal display apparatus appropriate for a case in which the output circuit of the present disclosure is applied to an output unit of the data driver and a control circuit. Hereinafter, the embodiments of the disclosure will be described with reference to the drawings.

Figure 1:
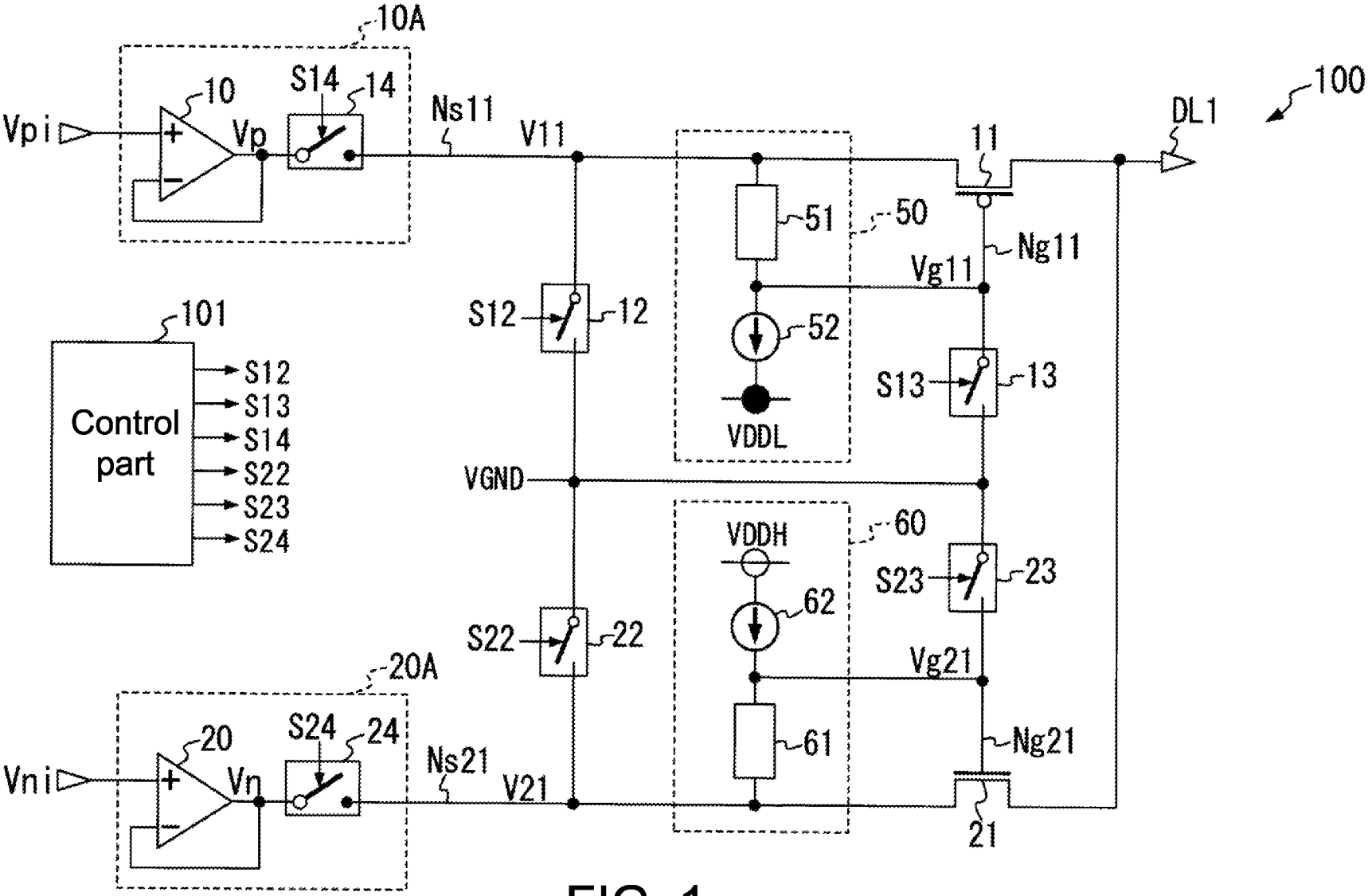
FIG. 1 is a circuit diagram illustrating an example of a configuration of an output circuit 100.

FIG. 1 is a circuit diagram illustrating a configuration of an output circuit 100 as an example of an output circuit according to the present disclosure.

First, power supply voltages to be supplied to the output circuit 100 will be described.

Power supply voltages to be supplied to the output circuit 100 include three voltages including a reference power supply voltage VGND, a positive power supply voltage VDDH having a higher voltage than the reference power supply voltage VGND, and a negative power supply voltage VDDL having a lower voltage than the reference power supply voltage VGND. In other words, the magnitude relationship between these three power supply voltages is assumed to be VDDH>VGND>VDDL. Further, in addition to the three power supply voltages, if there is another power supply voltage having a potential between the power supply voltages VDDL and VDDH, the other power supply voltage can also be used if needed.

Thus, in order to reduce a circuit area (reduction in cost) by reducing a withstanding voltage of each element constituting the output circuit 100, it is desirable for the withstanding voltage to be as low as possible (which will be denoted by a withstanding voltage VDDT) in a range in which the voltage exceeds the voltage differences (VDDH−VGND) and (|VDDL−VGND|) and be less than the voltage difference (VDDH−VDDL).

The output circuit 100 is an output circuit that receives a signal with a higher potential than the reference power supply voltage VGND as a positive voltage signal and a signal with a potential lower than the reference power supply voltage VGND as a negative voltage signal, switches between the positive voltage signal and the negative voltage signal at predetermined timings to output the signals to one capacitive load (e.g., a data line of a liquid crystal display apparatus), and thereby drives the capacitive load (polarity inversion driving).

The output circuit 100 includes an output terminal DL1 connected to one capacitive load, nodes Ns11 and Ns21, a positive voltage signal supply circuit 10A, a negative voltage signal supply circuit 20A, output selection switches 11 and 21, switches 12, 13, 22, and 23, voltage follower circuits 50 and 60, and a control part 101 as illustrated in FIG. 1.

The positive voltage signal supply circuit 10A includes an amplifying circuit 10 and a switch 14 as illustrated in FIG. 1. The amplifying circuit 10 receives an input voltage signal Vpi with a potential in the range from the reference power supply voltage VGND to the positive power supply voltage VDDH and outputs a signal obtained by amplifying the aforementioned input voltage signal as a positive voltage signal Vp. The switch 14 controls supply of the positive voltage signal Vp to the node Ns11 and cuts off the supply thereof. Further, the switch 14 is configured as a complementary switch with two conductive types of P and N channels for letting a positive voltage signal Vp in a wide voltage range pass therethrough. Both ends of the switch 14 are terminals with the same positive voltage range, and the switch may be simply a complementary switch. In addition, the amplifying circuit 10 may include the functions of the switch 14 therein, and in this case, the node Ns11 serves as the output node of the amplifying circuit 10. Furthermore, the amplifying circuit 10 is not limited to a voltage follower that amplifies and outputs the positive voltage signal Vp with the same potential as that of the input voltage signal Vpi, and it may be an amplifying circuit that amplifies and outputs the positive voltage signal Vp with a potential different from that of the input voltage signal Vpi. In the present specification, a positive voltage signal to be supplied from the positive voltage signal supply circuit 10A to the node Ns11 will be described as V11 or Vp.

With the above-described configuration, the positive voltage signal supply circuit 10A generates a positive signal with a potential in the range from the reference power supply voltage VGND to the positive power supply voltage VDDH as the positive voltage signal Vp, and supplies the voltage to the node Ns11 or cuts off the supply thereof.

The negative voltage signal supply circuit 20A includes an amplifying circuit 20 and a switch 24. The amplifying circuit 20 receives an input voltage signal Vni with a potential in the range from the negative power supply voltage VDDL to the reference power supply voltage VGND and outputs a signal obtained by amplifying the aforementioned input voltage signal as a negative voltage signal Vn. The switch 24 controls supply of the negative voltage signal Vn to the node Ns21 and cuts off the supply thereof. Further, the switch 24 is configured as a complementary switch with two conductive types of P and N channels for letting the negative voltage signal Vn in a wide voltage range pass therethrough. Both ends of the switch 24 are terminals with the same negative voltage range, and the switch may be simply a complementary switch. In addition, the amplifying circuit 20 may include the functions of the switch 24 therein, and in this case, the node Ns21 serves as the output node of the amplifying circuit 20. Furthermore, the amplifying circuit 20 is not limited to a voltage follower that amplifies and outputs the negative voltage signal Vn with the same potential as that of the input voltage signal Vni, and it may be an amplifying circuit that amplifies and outputs the negative voltage signal Vn with a potential different from that of the input voltage signal Vni. In the present specification, a voltage signal to be supplied from the negative voltage signal supply circuit 20A to the node Ns21 will be described as V21 or Vn.

With the above-described configuration, the negative voltage signal supply circuit 20A generates a negative signal with a potential in the range from the negative power supply voltage VDDL to the reference power supply voltage VGND as the negative voltage signal Vn, and supplies the voltage to the node Ns2 or cuts off the supply thereof.

The output selection switch 11 is configured as a P-channel transistor (which will be denoted also as a "P-channel transistor switch 11" below) having a first terminal (which will be denoted as a "source" below) connected to the node Ns11 and a second terminal (which will be denoted as a "drain" below) connected to the output terminal DL1. The output selection switch 11 outputs the voltage signal V11 of the node Ns11 to the output terminal DL1 when it is in an ON state.

The output selection switch 21 is configured as an N-channel transistor (which will be denoted also as an "N-channel transistor switch 21" below) having the source connected to the node Ns21 and the drain connected to the output terminal DL1. The output selection switch 21 outputs the voltage signal V21 of the node Ns21 to the output terminal DL1 when it is in an ON state.

The switch 12 is configured as an N-channel transistor switch connected between, for example, the node Ns11 and the reference power supply terminal from which the reference power supply voltage VGND is supplied. The switch 12 is controlled such that it is in an ON state or an OFF state according to the control signal S12 supplied from the control part 101. The switch 12 applies the reference power supply voltage VGND to the node Ns11 when it is in the ON state.

The switch 22 is configured as a P-channel transistor switch connected between, for example, the node Ns21 and the reference power supply terminal. The switch 22 is controlled such that it is in an ON state or an OFF state according to the control signal S22 supplied from the control part 101. The switch 22 applies the reference power supply voltage VGND to the node Ns21 when it is in the ON state.

The switch 13 is configured as a P-channel transistor switch connected between, for example, a gate Ng11 of the output selection switch (P-channel transistor switch) 11 and the reference power supply terminal. The switch 13 is controlled in conjunction with control of the switch 12 in the ON state, and when it is turned on along with the switch 12, it performs control such that the output selection switch 11 is turned off. Further, the switch 13 may be provided between the gate Ng11 of the output selection switch 11 and the node Ns11.

The switch 23 is configured as an N-channel transistor switch connected between, for example, a gate Ng21 of the output selection switch (N-channel transistor switch) 21 and the reference power supply terminal. The switch 23 is controlled in conjunction with control of the switch 22 in the ON state, and when it is turned on along with the switch 22, it performs control such that the output selection switch 21 is turned off. Further, the switch 23 may also be provided between the gate Ng21 of the output selection switch 21 and the node Ns21.

When at least one of the output selection switches 11 and 21 is controlled such that it is turned on in the operation of the switches 12, 13, 22, and 23 to output a positive or negative voltage signal (Vp or Vn) to the output terminal DL1, the other is controlled such that it is turned off.

Further, the switches 12 to 14 and 22 to 24 are controlled such that they are turned on and off using the control signals S12 to S14 and S22 to S24 output from the control part 101.

The voltage follower circuit 50 includes a load element 51 connected between the gate and the source of the output selection switch 11 and a current source 52 that is connected to one end of the load element 51 to set a value of a current flowing to the load element 51. With this configuration, the voltage follower circuit 50 follows the voltage signal V11 supplied to the source of the output selection switch 11 to supply a voltage obtained by shifting the voltage of the voltage signal V11 by a predetermined voltage difference to the gate of the output selection switch 11 as a gate voltage Vg11.

Further, the load element 51 sets a voltage difference between the gate and the source of the output selection switch 11 based on a resistance value thereof and a value of a current flowing therein. As a result, a withstanding voltage of each element can be set to be lower than the withstanding voltage VDDT. The load element 51 can be configured as a resistive element or a diode-connected transistor.

The current source 52 is connected between the connection point of the gate Ng11 of the output selection switch 11 and the load element 51 and a negative power supply terminal from which the negative power supply voltage VDDL is supplied, for example. The current source 52 generates a sink current with a predetermined current value flowing from the source of the output selection switch 11 to the gate Ng11 of the output selection switch 11 via the load element 51. Further, the current source 52 may be connected to a negative-side power supply terminal that is different from the negative power supply voltage VDDL.

The voltage follower circuit 50 performs control such that a voltage (absolute value) between the gate and the source of the P-channel output selection switch 11 is greater than a threshold voltage (absolute value). As a result, the output selection switch 11 is maintained in the ON state, and the positive voltage signal Vp is output to the output terminal DL1.

The voltage follower circuit 60 includes a load element 61 connected between the gate and the source of the output selection switch 21 and a current source 62 that is connected to one end of the load element 61 to set a value of a current flowing to the load element 61. With this configuration, the voltage follower circuit 60 follows the voltage signal V21 supplied to the source of the output selection switch 21 to supply a voltage obtained by shifting the voltage of the voltage signal V21 by a predetermined voltage difference to the gate of the output selection switch 21 as a gate voltage Vg21.

Further, the load element 61 sets a voltage difference between the gate and the source of the output selection switch 21 based on a resistance value thereof and a value of a current flowing therein. As a result, a withstanding voltage of each element can be set to be lower than the withstanding voltage VDDT. The load element 61 can be configured as a resistive element or a diode-connected transistor.

The current source 62 is connected between the connection point of the gate of the output selection switch 21 and the load element 61 and a positive power supply terminal from which the positive power supply voltage VDDH is supplied, for example. The current source 62 generates a source current with a predetermined current value flowing from the gate Ng21 of the output selection switch 21 to the source of the output selection switch 21 via the load element 61. Further, the current source 62 may be connected to a positive-side power supply terminal that is different from the positive power supply voltage VDDH.

The voltage follower circuit 60 performs control such that a voltage between the gate and the source of the N-channel output selection switch 21 is greater than a threshold voltage. As a result, the output selection switch 21 is maintained in the ON state, and the negative voltage signal Vn is output to the output terminal DL1.

Next, an element withstanding voltage of the output circuit 100 illustrated in FIG. 1 will be described.

Each element constituting the output circuit 100 is configured as a low-withstanding voltage element with the withstanding voltage VDDT that is lower than an output voltage range, and a minimum withstanding voltage is about half of the output voltage range. Specifically, because the positive voltage signal supply circuit 10A to the node Ns11 are kept in the range from the reference power supply voltage VGND to the positive power supply voltage VDDH, the amplifying circuit 10 and the switch 14 can be configured as transistors with the low-withstanding voltage VDDT. Likewise, because the negative voltage signal supply circuit 20A to the node Ns21 are kept in the range from the reference power supply voltage VGND to the negative power supply voltage VDDL, the amplifying circuit 20 and the switch 24 can be configured as transistors with the low-withstanding voltage VDDT.

The output selection switch (P-channel transistor switch) 11 is controlled by the voltage follower circuit 50 to be in the ON state when the positive voltage signal Vp is output to the output terminal DL1. At this time, voltages of each of the source and the drain of the output selection switch 11 are set to be within the positive voltage range from VGND to VDDH. A voltage difference between the gate and the source of the output selection switch 11 is controlled by the voltage follower circuit 50 to be within the withstanding voltage VDDT. Further, when the negative voltage signal Vn is output to the output terminal DL1, the switches 12 and 13 performs control such that the reference power supply voltage VGND is supplied to the gate and the source of the output selection switch 11 and the output selection switch 11 is in the OFF state.

Thus, even though the negative voltage signal Vn is output to the output terminal DL1 to which the drain of the output selection switch 11 is connected, voltages of the terminals including the source, drain, and gate of the output selection switch 11 are controlled such that they are within the withstanding voltage VDDT. Further, when a voltage signal to be output from the output terminal DL1 is switched from the positive voltage signal Vp to the negative voltage signal Vn, for example, control is performed such that the switch 13 is turned off with the switch 12 being on and the voltage follower circuit 50 is caused to operate, and thus the output terminal DL1 is first driven to be in the state of the reference power supply voltage VGND from the state of the positive voltage. Then, the operation switches to an output operation of the negative voltage signal Vn. As a result, the voltage difference between the terminals of the output selection switch 11 can be kept within the low withstanding voltage VDDT.

The output selection switch (N-channel transistor switch) 21 is controlled by the voltage follower circuit 60 to be in the ON state when the negative voltage signal Vn is output to the output terminal DL1. At this time, voltages of each of the source and the drain of the output selection switch 21 are set to be within the negative voltage range from VGND to VDDL. A voltage difference between the gate and the source of the output selection switch 21 is controlled by the voltage follower circuit 60 to be within the withstanding voltage VDDT. Further, when the positive voltage signal Vp is output to the output terminal DL1, the switches 22 and 23 performs control such that the reference power supply voltage VGND is supplied to the gate and the source of the output selection switch 21 and the output selection switch 21 is in the OFF state.

Thus, even though the positive voltage signal Vp is output to the output terminal DL1 to which the drain of the output selection switch 21 is connected, voltages of the terminals including the source, drain, and gate of the output selection switch 21 are controlled such that they are within the withstanding voltage VDDT. Further, when a voltage signal to be output from the output terminal DL1 is switched from the negative voltage signal Vn to the positive voltage signal Vp, for example, control is performed such that the switch 23 is turned off with the switch 22 being on and the voltage follower circuit 60 is caused to operate, and thus the output terminal DL1 is first driven to be in the state of the reference power supply voltage VGND from the state of the negative voltage. Then, the operation switches to an output operation of the positive voltage signal Vp. As a result, the voltage difference between the terminals of the output selection switch 21 can be kept within the withstanding voltage VDDT that is a low withstanding voltage.

As described above, the output circuit 100 of FIG. 1 can be configured as a transistor with the low withstanding voltage VDDT including the output selection switches 11 and 21.

Next, functions of the voltage follower circuits 50 and 60 will be described with reference to FIGS. 2A and 2B.

Figure 2A:
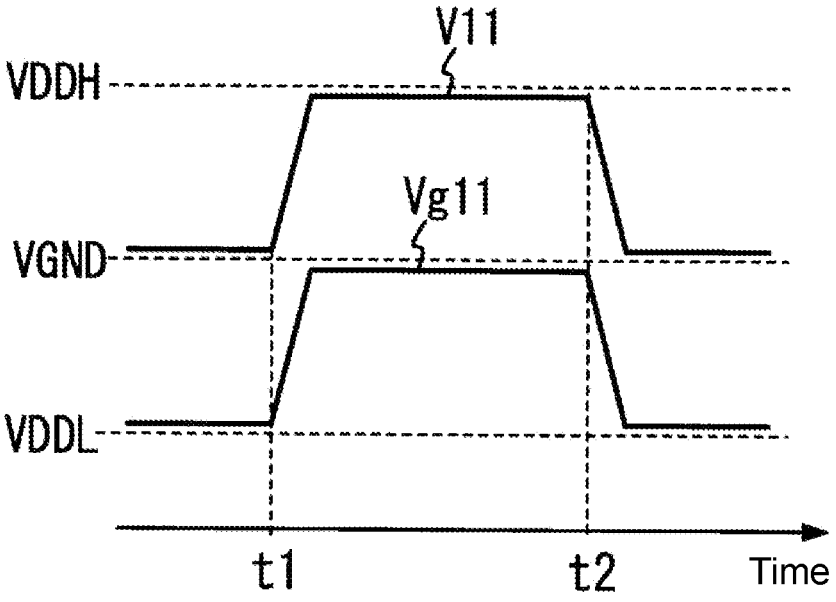
FIG. 2A is a waveform diagram illustrating a waveform of a gate voltage Vg11 generated by a voltage follower circuit 50 following that of a positive voltage signal Vp (V11).

FIG. 2A illustrates the waveform of the voltage signal V11 supplied to the source of the output selection switch 11 when the positive voltage signal Vp is continuously output and the waveform of the signal of the gate voltage Vg11 of the output selection switch 11 controlled by the voltage follower circuit 50.

FIG. 2A illustrates a waveform example in which the voltage signal V11 changes from a positive voltage close to the reference power supply voltage VGND to a positive voltage close to the positive power supply voltage VDDH at a time t1 and changes to a positive voltage close to the reference power supply voltage VGND again at a time t2.

The gate voltage Vg11 of the output selection switch 11 changes its voltage value following the voltage signal V11 while maintaining a voltage difference being negative and set based on the voltage difference between both ends of the load element 51. The voltage difference between both ends of the load element 51 is preferably about the voltage difference between the positive power supply voltage VDDH and the reference power supply voltage VGND or about the voltage difference (absolute value) between the negative power supply voltage VDDL and the reference power supply voltage VGND. Thus, the voltage difference between the terminals of the output selection switch 11 and the voltage difference between both ends of the load element 51 and the current source 52 are controlled such that they are within the voltage range of the withstanding voltage VDDT. Further, in a case in which the voltage difference between both ends of the load element 51 is set to a value smaller than about the voltage difference (absolute value) between the negative power supply voltage VDDL and the reference power supply voltage VGND, the gate voltage Vg11 of the output selection switch 11 may have a positive voltage exceeding the reference power supply voltage VGND when the voltage signal V11 is around the positive power supply voltage VDDH. In the case of the setting, the current source 52 connected between the gate Ng11 of the output selection switch 11 and the terminal of the negative power supply voltage may have a configuration in which multiple elements are vertically stacked in advance. As a result, each of the multiple elements can be reliably controlled such that it has a voltage within the range of the withstanding voltage VDDT.

Figure 2B:
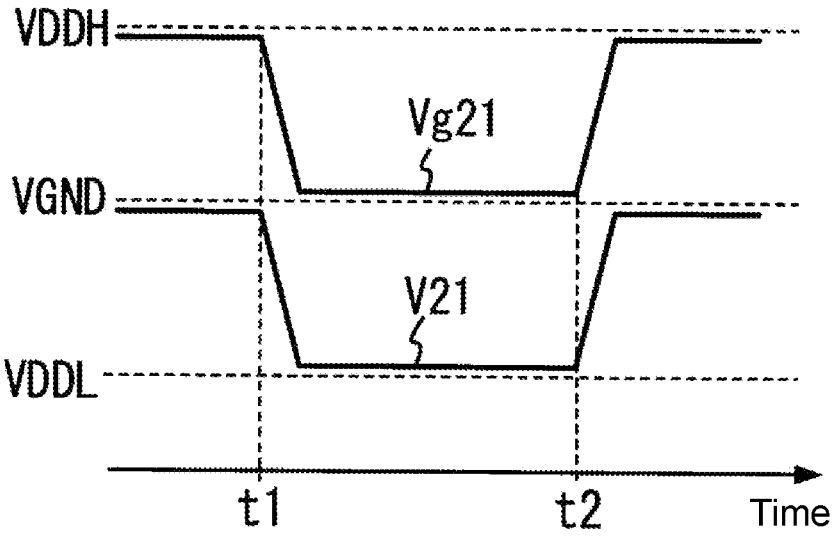
FIG. 2B is a waveform diagram illustrating a waveform of a gate voltage Vg21 generated by a voltage follower circuit 60 following that of a negative voltage signal Vn (V21).

FIG. 2B illustrates the waveform of the voltage signal V21 supplied to the source of the output selection switch 21 when the negative voltage signal Vn is continuously output and the waveform of the signal of the gate voltage Vg21 of the output selection switch 21 controlled by the voltage follower circuit 60.

FIG. 2B illustrates a waveform example in which the voltage signal V21 changes from a negative voltage close to the reference power supply voltage VGND to a negative voltage close to the negative power supply voltage VDDL at the time t1 and changes to a negative voltage close to the reference power supply voltage VGND again at the time t2.

The gate voltage Vg21 of the output selection switch 21 changes its voltage value following the voltage signal V21 while maintaining a voltage difference being positive and set based on the voltage difference between both ends of the load element 61. The voltage difference between both ends of the load element 61 is preferably about the voltage difference between the positive power supply voltage VDDH and the reference power supply voltage VGND or about the voltage difference (absolute value) between the negative power supply voltage VDDL and the reference power supply voltage VGND. Thus, the voltage difference between the terminals of the output selection switch 21 and the voltage difference between both ends of the load element 61 and the current source 62 are controlled such that it is within the voltage range of the withstanding voltage VDDT. Further, in a case in which the voltage difference between both ends of the load element 61 is set to a value smaller than about the voltage difference between the positive power supply voltage VDDH and the reference power supply voltage VGND, the gate voltage Vg21 of the output selection switch 21 may have a negative voltage exceeding the reference power supply voltage VGND when the voltage signal V21 is around the negative power supply voltage VDDL. In the case of the setting, the current source 62 connected between the gate Ng21 of the output selection switch 21 and the terminal of the positive power supply voltage may have a configuration in which multiple elements are vertically stacked in advance. As a result, each of the multiple elements can be reliably controlled such that it has a voltage within the range of the withstanding voltage VDDT.

As described above, in the output circuit 100, the first switch (11) configured as a P-channel transistor receives the positive voltage signal (Vp) with a voltage higher than the reference power supply voltage (VGND) via the first node (Ns11) and outputs the positive voltage signal to the output terminal (DL1) when the first switch is in the ON state. Furthermore, the second switch (21) configured as an N-channel transistor receives the negative voltage signal (Vn) with a voltage lower than the reference power supply voltage via the second node (Ns21) and outputs the negative voltage signal to the output terminal (DL1) when the second switch is in the ON state.

Here, the first and second switches (11 and 21) are controlled such that they are in the ON state by the first and second voltage follower circuits (50 and 60) having the following configuration. The first voltage follower circuit (50) includes the first load element (51) connected between the source and the gate of the first switch (11) and the first current source (52) that generates a current which flows to the first load element. With this configuration, the first voltage follower circuit can supply a voltage obtained by shifting the voltage of the positive voltage signal (Vp) supplied to the first node to the negative side by a predetermined voltage difference to the gate of the first switch to keep the first switch in the ON state regardless of the voltage value of the positive voltage signal. On the other hand, the second voltage follower circuit (60) includes the second load element (61) connected between the source and the gate of the second switch (21) and the second current source (62) that generates a current which flows to the second load element. With this configuration, the second voltage follower circuit can supply a voltage obtained by shifting the voltage of the negative voltage signal (Vn) supplied to the second node to the positive side by a predetermined voltage difference to the gate of the second switch to keep the second switch in the ON state regardless of the voltage value of the negative voltage signal.

Furthermore, the output circuit includes the third and fourth switches (12 and 22) that set the first and second nodes to the reference power supply voltage individually when the switches are in the ON state, and the first and second control sections (13 and 23) that set the first and second switches to be in the OFF states individually when the sections are in an active state. Thus, when a positive voltage signal is output from the output terminal (DL1), the second switch (21) is controlled such that it is in the OFF state and the second node (Ns21) is set to the reference power supply voltage. On the other hand, when a negative voltage signal is output from the output terminal (DL1), the first switch (11) is controlled such that it is in the OFF state and the first node (Ns11) is set to the reference power supply voltage.

With this configuration, for each switch that handles a positive voltage signal with a voltage higher than the reference power supply voltage and a negative voltage signal with a voltage lower than the reference power supply voltage, a transistor with a withstanding voltage (VDDT) that is about half of the voltage range from a minimum voltage (VDDL) of the negative voltage signal to a maximum voltage (VDDH) can be used. Furthermore, control across polarities for the output selection switches (11 and 21) to keep the output selection switches in the ON state can be realized using simple analog circuits including the load elements (51 and 61) and the current sources (52 and 62) that allow a current which flows to the load elements, like the voltage follower circuits (50 and 60).

Thus, the configuration enables the output circuit that selectively outputs one of the positive voltage signal and the negative voltage signal to have a reduced area (cost reduction) in a simple configuration.

Further, the output circuit 100 illustrated in FIG. 1 and each example introduced below can be configured as P-channel and N-channel MOS transistor circuits that are formed on a semiconductor substrate such as a silicon substrate. In addition, they can be configured also as P-channel and N-channel thin-film transistor circuits formed on an insulating substrate such as glass or plastic. Further, the back gate in a case in which the output circuit is configured as an MOS transistor is also controlled such that a voltage difference between the terminals including the gate, the drain, and the source is within the low withstanding voltage VDDT.

Example 2

Figure 3:
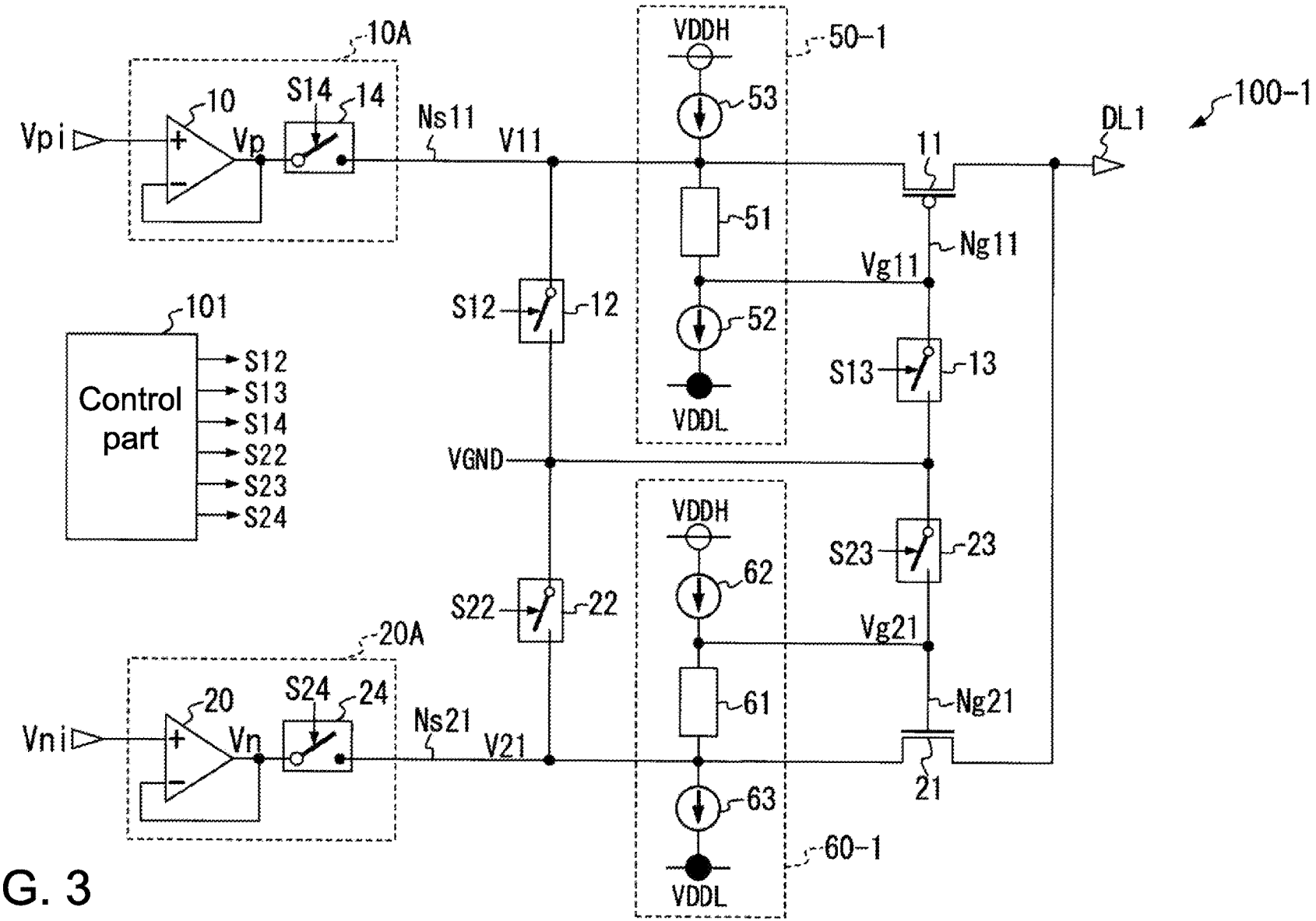
FIG. 3 is a circuit diagram illustrating an output circuit 100-1 as a first modified example of the output circuit 100 illustrated in FIG. 1.

FIG. 3 is a circuit diagram illustrating an output circuit 100-1 as a first modified example of the output circuit 100 illustrated in FIG. 1.

Further, in the output circuit 100-1 illustrated in FIG. 3, only the voltage follower circuits 50 and 60 of the output circuit 100 are changed to voltage follower circuits 50-1 and 60-1, and other constituent elements are the same as those in FIG. 1. The voltage follower circuits 50-1 and 60-1 realize the operations illustrated in FIGS. 2A and 2B, like the voltage follower circuits 50 and 60.

The voltage follower circuit 50-1 illustrated in FIG. 3 includes a current source 53 that is further connected to the source of the output selection switch 11 and generates a source current having the same current value as that of a current source 52, the current flowing to the source of the output selection switch 11, in addition to the configuration of the voltage follower circuit 50 illustrated in FIG. 1. Specifically, the current source 53 is connected, for example, between the source of the output selection switch 11 and the positive power supply voltage VDDH and supplies a constant current having the same current value as the current generated by the current source 52 to the source of the output selection switch 11. As a result, even when a drive capacity of the amplifying circuit 10 of a positive voltage signal supply circuit 10A is relatively low, the influence of consumption of the current flowing to the load element 51 from the source of the output selection switch 11, that is, an increase in the output offset, can be avoided.

Likewise, the voltage follower circuit 60-1 illustrated in FIG. 3 includes a current source 63 that is further connected to the source of the output selection switch 21 and generates a sink current having the same current value as that of the current source 62, the current flowing from the source of the output selection switch 21, in addition to the configuration of the voltage follower circuit 60 illustrated in FIG. 1. Specifically, the current source 63 is connected between the source of the output selection switch 21 and the negative power supply voltage VDDL and takes out a constant current having the same current value as the current generated by the current source 62 from the source of the output selection switch 11. As a result, even when a drive capacity of the amplifying circuit 20 of a negative voltage signal supply circuit 20A is relatively low, the influence of consumption of the current flowing to the source of the output selection switch 21 from the load element 61, that is, an increase in the output offset, can be avoided.

Further, in a case in which the amplifying circuits 10 and 20 have a sufficiently high current drive capability for the current flowing to the load elements 51 and 61, there is no need to provide the current sources 53 and 63.

In addition, although exemplary configurations without the current sources 53 and 63 are introduced in each of the examples illustrated in FIGS. 4 to 7 which will be described below, a configuration with the current source 53 or 63 may be employed.

Example 3

Figure 4:
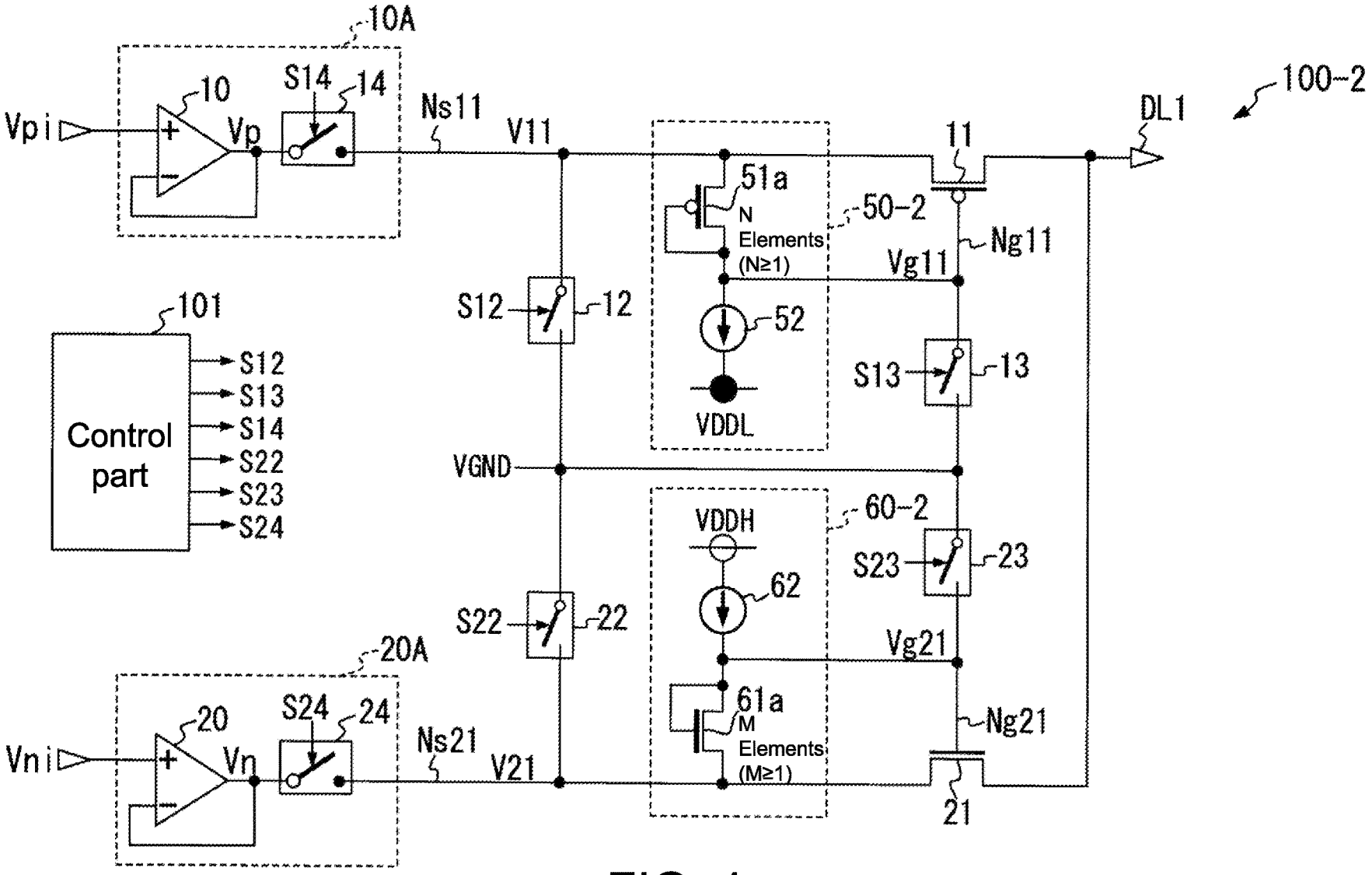
FIG. 4 is a circuit diagram illustrating an output circuit 100-2 as a second modified example of the output circuit 100 illustrated in FIG. 1.

FIG. 4 is a circuit diagram illustrating an output circuit 100-2 as a second modified example of the output circuit 100 illustrated in FIG. 1.

Further, as voltage follower circuits 50 and 60, the output circuit 100-2 illustrated in FIG. 4 employs voltage follower circuits 50-2 and 60-2 representing specific examples of the configurations of the voltage follower circuits 50 and 60. The voltage follower circuits 50-2 and 60-2 realize the operations illustrated in FIGS. 2A and 2B, respectively, like the voltage follower circuits 50 and 60.

The voltage follower circuit 50-2 is provided with, as the load element 51, a diode-connected transistor circuit 51*a* that has connected P-channel transistors with an N (N≥1) diode-connected configuration, between the gate and the source of the output selection switch 11. The P-channel transistors with the N diode-connected configuration each have source sides connected to the source of the output selection switch 11 and drain and gate sides commonly connected to the connection point of the gate of the output selection switch 11 and the current source 52. Further, in a case in which the diode-connected transistor circuit 51*a* is configured with multiple P-channel transistors each connected to diodes, they may be connected in a series form, a parallel form, or a form in which series and parallel forms are mixed. The current source 52 sets a value of a current flowing to the P-channel transistor circuit 51*a*.

Here, a voltage (absolute value) between the gate and the source of the output selection switch 11 is controlled such that it is higher than a threshold voltage (absolute value) based on a configuration of the N diode-connected transistors that determines a resistance value of the diode-connected transistor circuit 51*a*, the size of each transistor, and the above-mentioned current value. As a result, the output selection switch 11 is maintained in the ON state, and the positive voltage signal Vp is output to the output terminal DL1 via the output selection switch 11.

Further, although omitted in FIG. 4, the diode-connected transistor circuit 51*a* can also be configured as an N-channel transistor circuit with an N diode-connected configuration. In this case, the N-channel transistors with the N diode-connected configuration each have drain and gate sides connected to the source of the output selection switch 11 and source sides commonly connected to the connection point of the gate of the output selection switch 11 and the current source 52. However, in a case in which the load element 51 is to be realized by the diode-connected transistor circuit 51*a* illustrated in FIG. 4, it is preferably configured with transistors of the same conductive type as the output selection switch 11. In a case in which the load element 51 is configured with transistors of a different conductive type from the output selection switch 11, changes caused by variations in processing threshold voltages of the transistors and operation environments differ for each conductive type, and thus the on-resistance of the output selection switch 11 is likely to change. On the other hand, in a case in which the load element 51 is configured with transistors of the same conductive type as the output selection switch 11, changes caused by variations in processing threshold voltages of the transistors and operation environments are linked, and thus the on-resistance of the output selection switch 11 can be less likely to change.

The voltage follower circuit 60-2 is provided with, as the load element 61, a diode-connected transistor circuit 61*a* that has connected N-channel transistors with an M (M≥1) diode-connected configuration, between the gate and the source of the output selection switch 21. The N-channel transistors with the M diode-connected configuration each have source sides connected to the source of the output selection switch 21 and drain and gate sides commonly connected to the connection point of the gate of the output selection switch 21 and the current source 62. Further, in a case in which the diode-connected transistor circuit 61*a* is configured with multiple N-channel transistors each connected to diodes, they may be connected in a series form, a parallel form, or a form in which series and parallel forms are mixed. The current source 62 sets a value of a current flowing to the diode-connected transistor circuit 61*a*.

Here, a voltage between the gate and the source of the output selection switch 21 is controlled such that it is higher than a threshold voltage based on a configuration of the M diode-connected transistors that determines a resistance value of the diode-connected transistor circuit 61*a*, the size of each transistor, and the above-mentioned current value. As a result, the output selection switch 21 is maintained in the ON state, and the negative voltage signal Vn is output to the output terminal DL1 via the output selection switch 21.

Further, although omitted in FIG. 4, the diode-connected transistor circuit 61*a* can also be configured with P-channel transistors with an M diode-connected configuration. In this case, the P-channel transistors with the M diode-connected configuration each have drain and gate sides connected to the source of the output selection switch 21 and source sides commonly connected to the connection point of the gate of the output selection switch 21 and the current source 62. However, in a case in which the load element 61 is configured with transistors with a diode-connected configuration, it is preferably configured with transistors of the same conductive type as the output selection switch 21. In a case in which the load element 61 is configured with transistors of a different conductive type from the output selection switch 21, changes caused by variations in processing threshold voltages of the transistors and operation environments differ for each conductive type, and thus the on-resistance of the output selection switch 21 is likely to change. On the other hand, in a case in which the load element 61 is configured with transistors of the same conductive type as the output selection switch 21, changes caused by variations in processing threshold voltages of the transistors and operation environments are linked, and thus the on-resistance of the output selection switch 21 can be less likely to change.

Example 4

Figure 5:
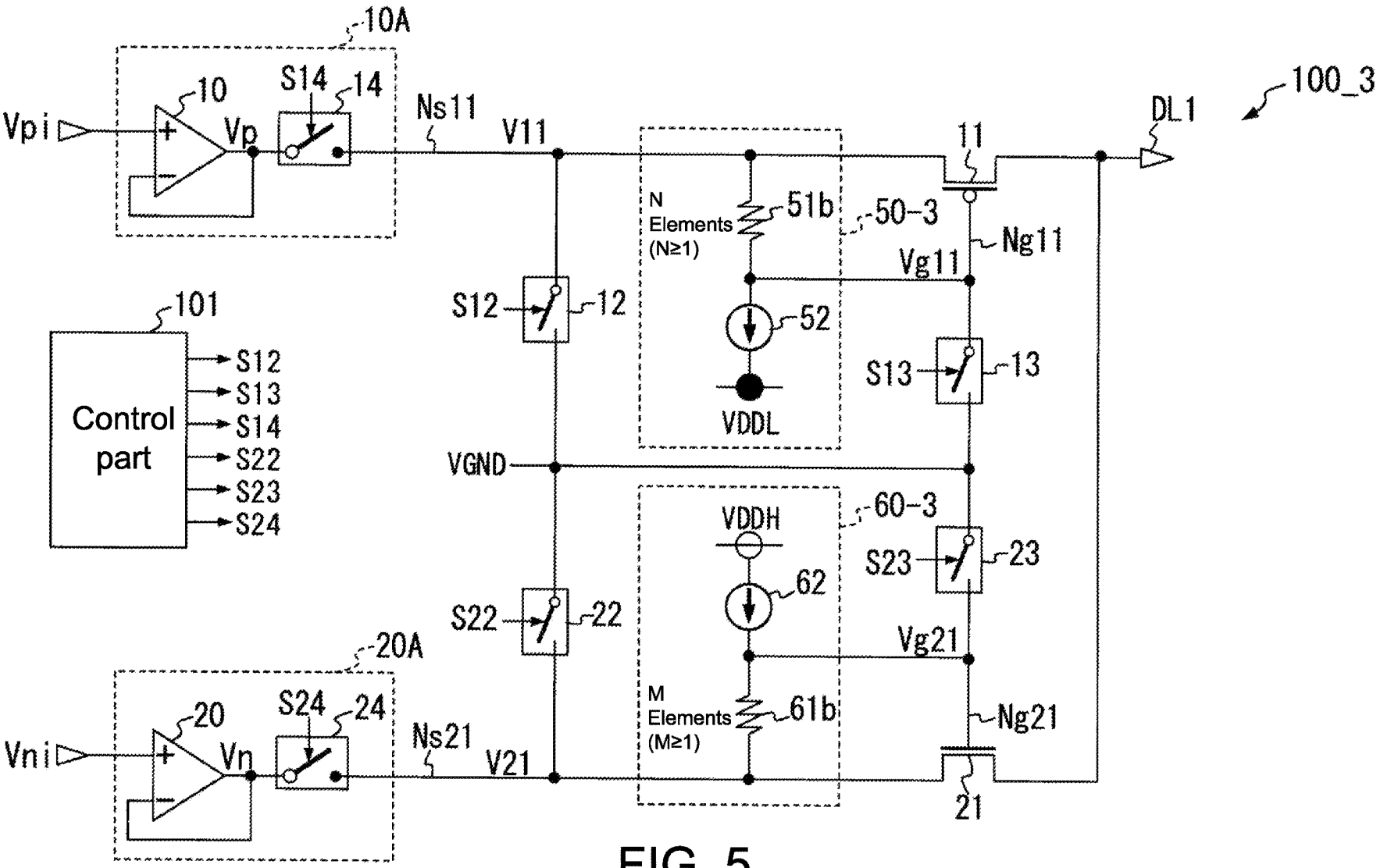
FIG. 5 is a circuit diagram illustrating an output circuit 100-3 as a third modified example of the output circuit 100 illustrated in FIG. 1.

FIG. 5 is a circuit diagram illustrating an output circuit 100-3 as a third modified example of the output circuit 100 illustrated in FIG. 1.

Further, as the voltage follower circuits 50 and 60, the output circuit 100-3 employs voltage follower circuits 50-3 and 60-3 representing other specific examples of the configurations of the voltage follower circuits 50 and 60. The voltage follower circuits 50-3 and 60-3 each realize the operations illustrated in FIGS. 2A and 2B, like the voltage follower circuits 50 and 60.

The voltage follower circuit 50-3 includes, as the load element 51, a resistive element circuit 51*b* configured to have N (N≥1) connected resistive elements between the gate and the source of the output selection switch 11. In a case in which the resistive element circuit 51*b* is configured with multiple resistive elements, they may be connected in a series form, a parallel form, or a form in which series and parallel forms are mixed. The current source 52 sets a value of a current flowing to the resistive element circuit 51*b*.

Here, a voltage (absolute value) between the gate and the source of the output selection switch 11 is controlled such that it is higher than a threshold voltage (absolute value) based on a resistance value of the resistive element circuit 51*b* and the above-mentioned current value. As a result, the output selection switch 11 is maintained in the ON state, and the positive voltage signal Vp is output to the output terminal DL1 via the output selection switch 11.

The voltage follower circuit 60-3 includes, as the load element 61, a resistive element circuit 61*b* configured to have M (M≥1) connected resistive elements between the gate and the source of the output selection switch 21. In a case in which the resistive element circuit 61*b* is configured with multiple resistive elements, they may be connected in a series form, a parallel form, or a form in which series and parallel forms are mixed. The current source 62 sets a value of a current flowing to the resistive element circuit 61*b*.

Here, a voltage between the gate and the source of the output selection switch 21 is controlled such that it is higher than a threshold voltage based on a resistance value of the resistive element circuit 61*b* and the above-mentioned current value. As a result, the output selection switch 21 is maintained in the ON state, and the negative voltage signal Vn is output to the output terminal DL1 via the output selection switch 21.

Example 5

Figure 6:
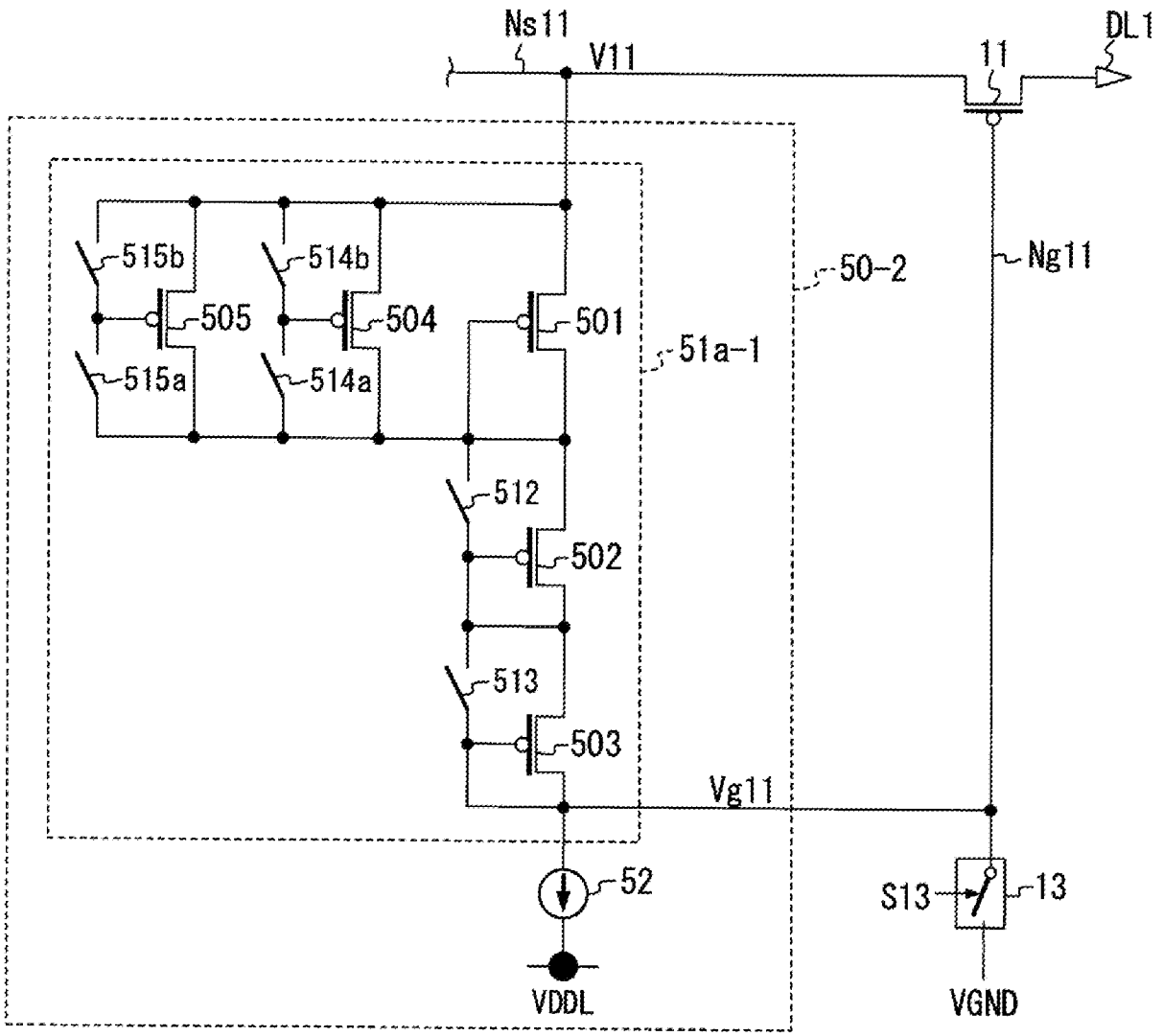
FIG. 6 is a circuit diagram illustrating a diode-connected transistor circuit 51*a*-1 as a modified example of the diode-connected transistor circuit 51*a* illustrated in FIG. 4.

FIG. 6 is a circuit diagram illustrating a diode-connected transistor circuit 51*a*-1 as a modified example of the diode-connected transistor circuit 51*a* included in the voltage follower circuit 50-2 of the output circuit 100-2 illustrated in FIG. 4.

The diode-connected transistor circuit 51*a*-1 illustrated in FIG. 6 is configured such that a function of adjusting a set value of a voltage between the gate and the source of the output selection switch 11 is added to the diode-connected transistor circuit 51*a* illustrated in FIG. 4. Further, although the peripheral circuits (11, 13, and 52) connected to the diode-connected transistor circuit 51*a*-1 are illustrated all together in FIG. 6, only the configuration of the diode-connected transistor circuit 51*a*-1 will be described below.

In the diode-connected transistor circuit 51*a*-1 in FIG. 6, P-channel transistors 501 to 503 with a diode-connected configuration are connected between the source (the node Ns11) and the gate (Ng11) of the output selection switch 11 in a vertically stacked manner. Further, switches 512 and 513 are connected respectively between the gate and the source of each of the P-channel transistors 502 and 503.

In addition, P-channel transistors 504 and 505 each with a diode-connected configuration are connected in parallel with the P-channel transistor 501.

A switch 514*a* that activates the diode-connected configuration when it is on is connected between the gate and the drain of the P-channel transistor 504, and a switch 514*b* that deactivates the diode-connected configuration when it is on is connected between the gate and the source of the transistor. The switches 514*a* and 514*b* are controlled such that, when one is on, the other is off. Likewise, a switch 515*a* is connected between the gate and the drain of the P-channel transistor 505, and a switch 515*b* is connected between the gate and the source of the transistor.

All of the P-channel transistors 501 to 505 have the gates and the drains connected when the diode-connected configuration is activated.

The P-channel transistors 501 to 503 set three stages of predetermined voltages each of which is a voltage between the drain and the source of each of the transistors higher than the threshold voltage (absolute value) of the output selection switch 11 to a voltage between the gate and the source of the output selection switch 11. At this time, one or both of the switches 512 and 513 are turned on, the number of stages of the vertical stacking can be adjusted to one to three, and thus the set value of the voltage between the gate and the source of the output selection switch 11 can be greatly adjusted.

On the other hand, the parallel-connected P-channel transistors 501, 504, and 505 are provided to finely adjust the voltage difference for one stage of the diode-connected configuration. In other words, by turning on one or both of the switches 514*a* and 515*a*, the voltage differences between the drains and the sources of the P-channel transistors 501, 504, and 505 can be finely adjusted.

With the above-described configuration, the diode-connected transistor circuit 51*a*-1 illustrated in FIG. 6 performs the control of activating or deactivating the diode-connected configuration of the P-channel transistors with the N diode-connected configuration with the switches (512 to 515), and thus can adjust a set value of the voltage between the gate and the source of the output selection switch 11.

Further, the voltage follower circuit 60-2 of the output circuit 100-2 illustrated in FIG. 4 can be modified similarly to the configuration illustrated in FIG. 6. In other words, by configuring the diode-connected transistor circuit 61*a* illustrated in FIG. 4 such that the N-channel transistors with the M diode-connected configuration are combined in vertical stacking and parallel connection and controlling activation or deactivation of the diode-connected configuration of each of the N-channel transistors with the switch, a set value of the voltage between the gate and the source of the output selection switch 21 can be adjusted as in FIG. 6.

Example 6

Figure 7:
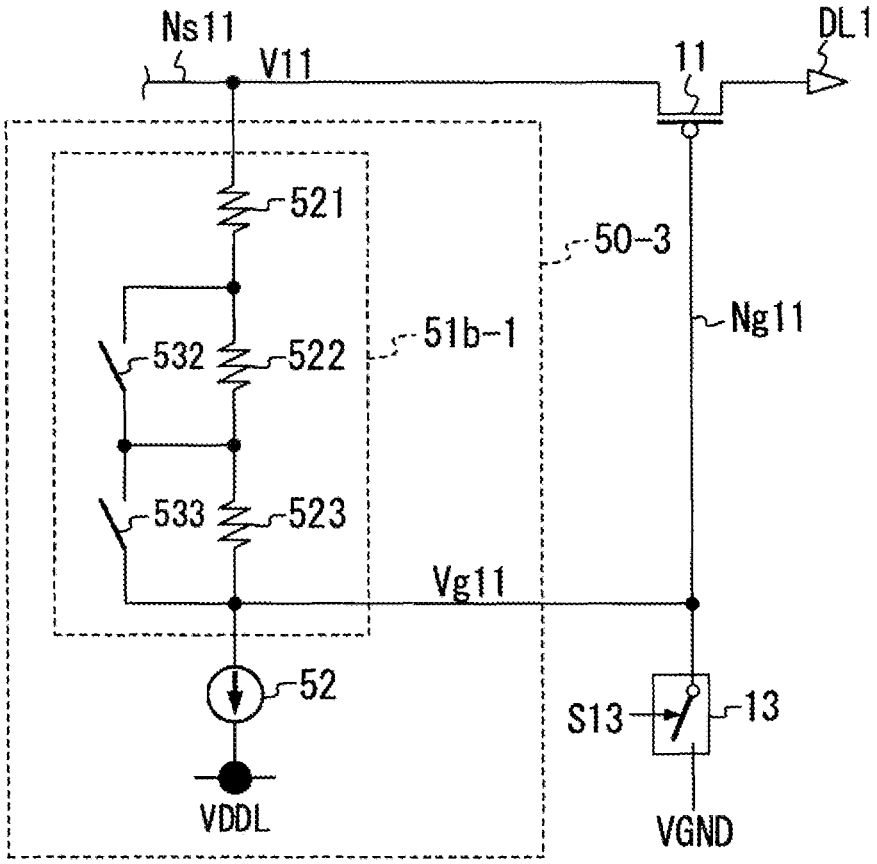
FIG. 7 is a circuit diagram illustrating a resistive element circuit 51*b*-1 as a modified example of the resistive element circuit 51*b* illustrated in FIG. 5.

FIG. 7 is a circuit diagram illustrating a resistive element circuit 51*b*-1 as a modified example of the resistive element circuit 51*b* included in the voltage follower circuit 50-3 of the output circuit 100-3 illustrated in FIG. 5.

The resistive element circuit 51*b*-1 illustrated in FIG. 7 has a configuration in which a function of adjusting a set value of a voltage between the gate and the source of the output selection switch 11 is added. Further, although the peripheral circuits (11, 13, and 52) connected to the resistive element circuit 51*b*-1 are illustrated all together in FIG. 7, only the configuration of the resistive element circuit 51*b*-1 will be described below.

The resistive element circuit 51*b*-1 has resistive elements 521 to 523 connected in series between the source (the node Ns11) and the gate (the node Ng11) of the output selection switch 11 as illustrated in FIG. 7. Further, the resistive elements 522 and 523 are connected to switches 532 and 533 in parallel with the elements, respectively. By turning on or off the switches 532 and 533 individually, the resistive element circuit 51*b*-1 can be controlled such that it has four levels of resistance values including a single resistance value of the resistor 521, a combined resistance value of the resistors 521 and 522, a combined resistance value of the resistors 521 and 523, and a combined resistance value of the resistors 521 to 533. With this configuration, a set value of the voltage between the gate and the source of the output selection switch 11 can be greatly adjusted.

As described above, the resistive element circuit 51*b*-1 illustrated in FIG. 7 has the function of adjusting a set value of the voltage between the gate and the source of the output selection switch 11 by combining N resistive elements and controlling activation and deactivation of each resistive element using a switch.

Further, the resistive element circuit 61*b* of the voltage follower circuit 60-3 of the output circuit 100-3 illustrated in FIG. 5 can also be modified similarly to the configuration illustrated in FIG. 7. In other words, the resistive element circuit 61*b* illustrated in FIG. 5 can adjust a set value of the voltage between the gate and the source of the output selection switch 21 by connecting N resistive elements and controlling activation and deactivation of each resistive element using a switch, as in FIG. 7.

Example 7

Figure 8:
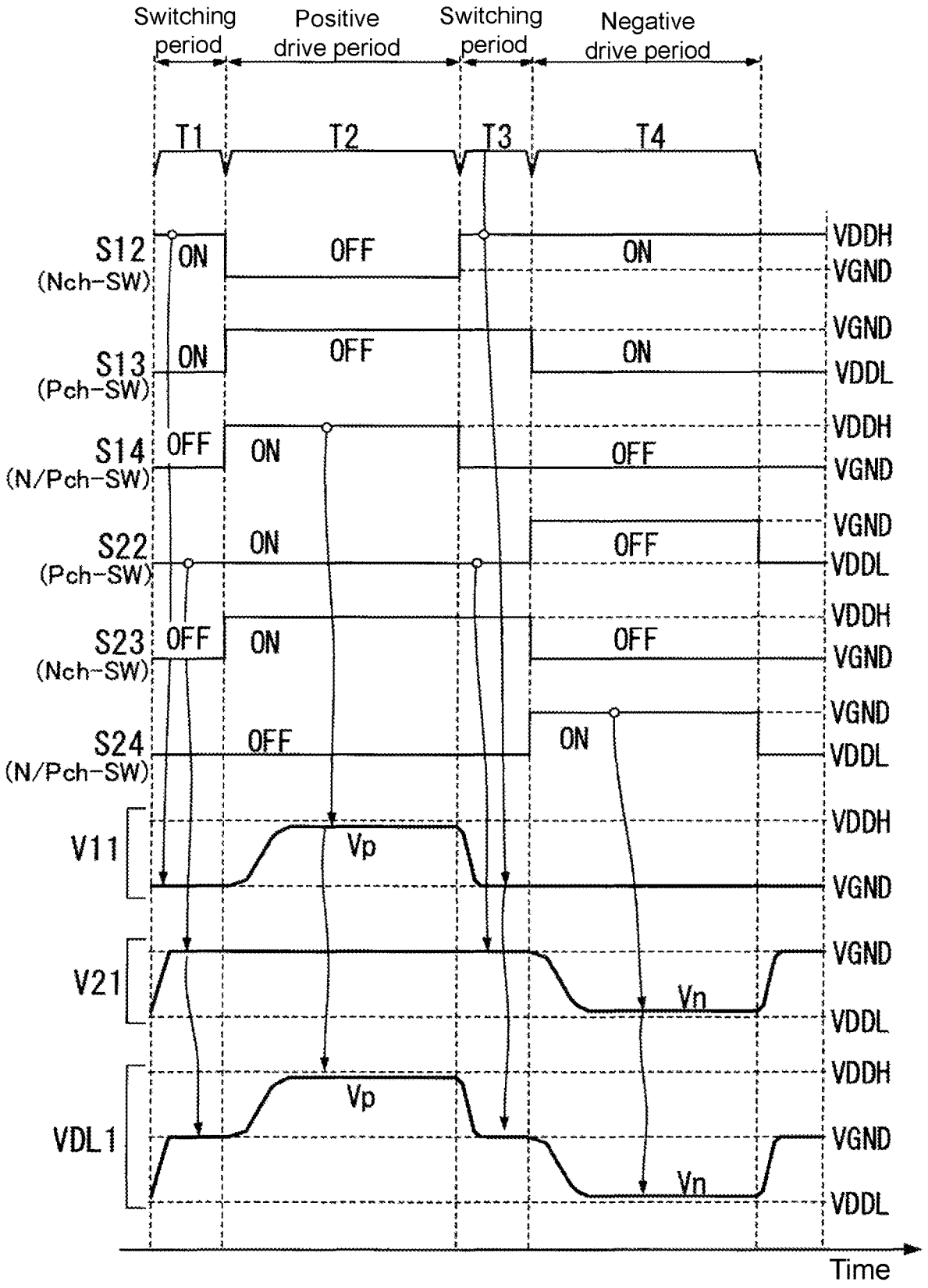
FIG. 8 is a timechart showing an example of control signals S12 to S14 and S22 to S24 generated by a control part 101 illustrated in FIG. 1.

FIG. 8 is a timechart showing an example of control signals S12 to S14 and S22 to S24 generated by the control part 101 illustrated in FIG. 1.

Further, FIG. 8 illustrates examples of control signals generated by the control part 101 when the output circuit 100 periodically switches and outputs the positive voltage signal Vp and the negative voltage signal Vn in an alternating manner, that is, when the output circuit performs polarity inversion driving. In addition, FIG. 8 illustrates control of turning on and off the switches 12 to 14 and 22 to 24, and voltage waveforms of the positive voltage signal V11 of the node Ns11, the negative voltage signal V21 of the node Ns21, and an output voltage VDL1 with respect to the output terminal DL1 in each of a positive drive period (T2) in which the positive voltage signal Vp is output and a negative drive period (T4) in which the negative voltage signal Vn is output. Further, the positive voltage signal Vp and the negative voltage signal Vn may be single- or multiple-step signals within a voltage range corresponding to their polarities.

Switching periods T1 and T3 are provided between the positive drive period T2 and the negative drive period T4, and the output terminal DL1 is first driven at the reference power supply voltage VGND in the switching periods to prevent the element from exceeding the withstanding voltage. In addition, the positive drive period T2 and the negative drive period T4 may be divided into multiple periods in which multiple voltage signals with the same polarity are sequentially output.

Here, for example, it is assumed that the switches 12 and 23 are N-channel transistor switches, the switches 13 and 22 are P-channel transistor switches, and the switches 14 and 24 are complementary transistor switches.

For the control signals S12 to S14 and S22 to S24 for controlling the switches, power supply voltages are supplied according to the voltage polarities of the switches controlled with the signals. The power supply voltages supplied to the N-channel transistor switches indicate the control states of the complementary transistor switches 14 and 24 being turned on and off.

Further, it is assumed in the example illustrated in FIG. 8 that the state immediately before the switching period T1 (initial state) is the state in which the negative voltage signal Vn generated by the negative voltage signal supply circuit 20A is supplied to the output terminal DL1 via the output selection switch 21, that is, the operation state in the negative drive period T4.

In FIG. 8, first in the switching period T1, the switches 14 and 24 are caused to be in the OFF state together due to the control signals S14 and S24, and thus the supply of the voltage signals from the positive voltage signal supply circuit 10A and the negative voltage signal supply circuit 20A is cut off. In addition, the switches 12 and 13 are caused to be in the ON state together due to the control signals S12 and S13, and thus the reference power supply voltage VGND is supplied to the gate and the source (the node Ns11) of the output selection switch (P-channel transistor switch) 11. As a result, the voltage follower circuit 50 gets into an inactive state, the output selection switch 11 gets into the OFF state, and the positive voltage signal V11 of the node Ns11 comes to have the reference power supply voltage VGND. In addition, the switch 22 is caused to be in the ON state due to the control signal S22, and thus the reference power supply voltage VGND is supplied to the source (the node Ns21) of the output selection switch (N-channel transistor switch) 21. In addition, the switch 23 is caused to be in the OFF state due to the control signal S23, and the output selection switch 21 is caused to be in the ON state due to the voltage follower circuit 60.

As a result, the negative voltage signal V21 of the node Ns21 is raised to the reference power supply voltage VGND, and the output voltage VDL1 with respect to the output terminal DL1 is raised to the reference power supply voltage VGND via the output selection switch 21.

Next, in the positive drive period T2, the switches 22 and 23 are caused to be in the ON state together due to the control signals S22 and S23, and thus the reference power supply voltage VGND is supplied to the gate and the source (the node Ns21) of the output selection switch 21. As a result, the voltage follower circuit 60 becomes inactive, the output selection switch 21 gets into the OFF state, and the negative voltage signal V21 of the node Ns21 comes to have the reference power supply voltage VGND. In addition, the switches 12 and 13 are caused to be in the OFF state due to the control signals S12 and S13, the voltage follower circuit 50 becomes active, and the output selection switch 11 is caused to be in the ON state. Furthermore, the switch 24 is caused to be in the OFF state due to the control signal S24, and the supply of the voltage signal from the negative voltage signal supply circuit 20A is continuously cut off.

On the other hand, the switch 14 is caused to be in the ON state due to the control signal S14, and the positive voltage signal Vp (V11) is supplied from the positive voltage signal supply circuit 10A to the node Ns11. In addition, the output voltage VDL1 with respect to the output terminal DL1 is raised to the positive voltage signal Vp via the output selection switch 11 being in the ON state. Further, in the positive drive period T2, because the ON state of the output selection switch 11 is maintained due to the voltage follower circuit 50 even if the voltage Vp output from the positive voltage signal supply circuit 10A is changed, the output voltage VDL1 also changes following the voltage Vp.

Next, in the switching period T3, the switches 14 and 24 are caused to be in the OFF state together due to the control signals S14 and S24, and thus the supply of the voltage signals from the positive voltage signal supply circuit 10A and the negative voltage signal supply circuit 20A is cut off. In addition, the switches 22 and 23 are continuously in the ON state due to the control signals S22 and S23, the voltage follower circuit 60 becomes inactive, the output selection switch 21 continues to be in the OFF state, and the negative voltage signal V21 of the node Ns21 is maintained at the reference power supply voltage VGND. On the other hand, the switch 12 is caused to be in the ON state due to the control signal S12, and thus the reference power supply voltage VGND is supplied to the source (the node Ns11) of the output selection switch (P-channel transistor switch) 11. In addition, the switch 13 is continuously in the OFF state due to the control signal S13, and the output selection switch 11 is kept in the ON state due to the voltage follower circuit 50.

As a result, the voltage signal V11 of the node Ns11 is reduced to the reference power supply voltage VGND, and the output voltage VDL1 with respect to the output terminal DL1 is reduced to the reference power supply voltage VGND via the output selection switch 11.

Next, in the negative drive period T4, the switches 12 and 13 are caused to be in the ON state together due to the control signals S12 and S13, and thus the reference power supply voltage VGND is supplied to the gate and the source (the node Ns11) of the output selection switch 11. As a result, the voltage follower circuit 50 becomes inactive, the output selection switch 11 gets into the OFF state, and the voltage signal V11 of the node Ns11 is kept at the reference power supply voltage VGND. In addition, the switches 22 and 23 are caused to be in the OFF state due to the control signals S22 and S23, the voltage follower circuit 60 becomes active, and the output selection switch 21 is caused to be in the ON state. Furthermore, the switch 14 is caused to be in the OFF state due to the control signal S14, and the supply of the voltage signal from the positive voltage signal supply circuit 10A is continuously cut off. On the other hand, the switch 24 is caused to be in the ON state due to the control signal S24, and the negative voltage signal Vn (V21) is supplied from the negative voltage signal supply circuit 20A to the node Ns21. In addition, the output voltage VDL1 with respect to the output terminal DL1 is reduced to the negative voltage signal Vp via the output selection switch 21 being in the ON state. Further, in the negative drive period T4, the ON state of the output selection switch 21 is maintained due to the voltage follower circuit 60 even if a voltage value of the negative voltage signal Vn output from the negative voltage signal supply circuit 20A is changed, and thus the output voltage VDL1 also changes following the voltage value of the negative voltage signal Vn.

Further, in the switching period T1 and T3, one of the voltage follower circuits 50 or 60 becomes inactive. Thus, a switch that temporarily cuts off the current from the current source included in the inactive voltage follower circuit 50 or 60 may be further provided.

In addition, although the drive control example in which the positive drive period and the negative drive period are alternately switched has been described in the example, the control is performed according to a rise or fall of a power supply voltage when power is turned on or off. When the power supply voltage is raised or falls, for example, a capacitive load externally connected to the output terminal DL1 is driven at the reference power supply voltage, and thus the control part 101 performed control such that, for example, the supply of the voltage signals from the positive voltage signal supply circuit 10A and the negative voltage signal supply circuit 20A is cut off (the switches 14 and 24 are turned off), the switches 12 and 22 are turned on together, and the switches 13 and 23 are turned off together. Furthermore, control may be performed such that the voltage follower circuits 50 and 60 are caused to be active together, and the output selection switches 11 and 21 are turned on together.

Example 8

Figure 9:
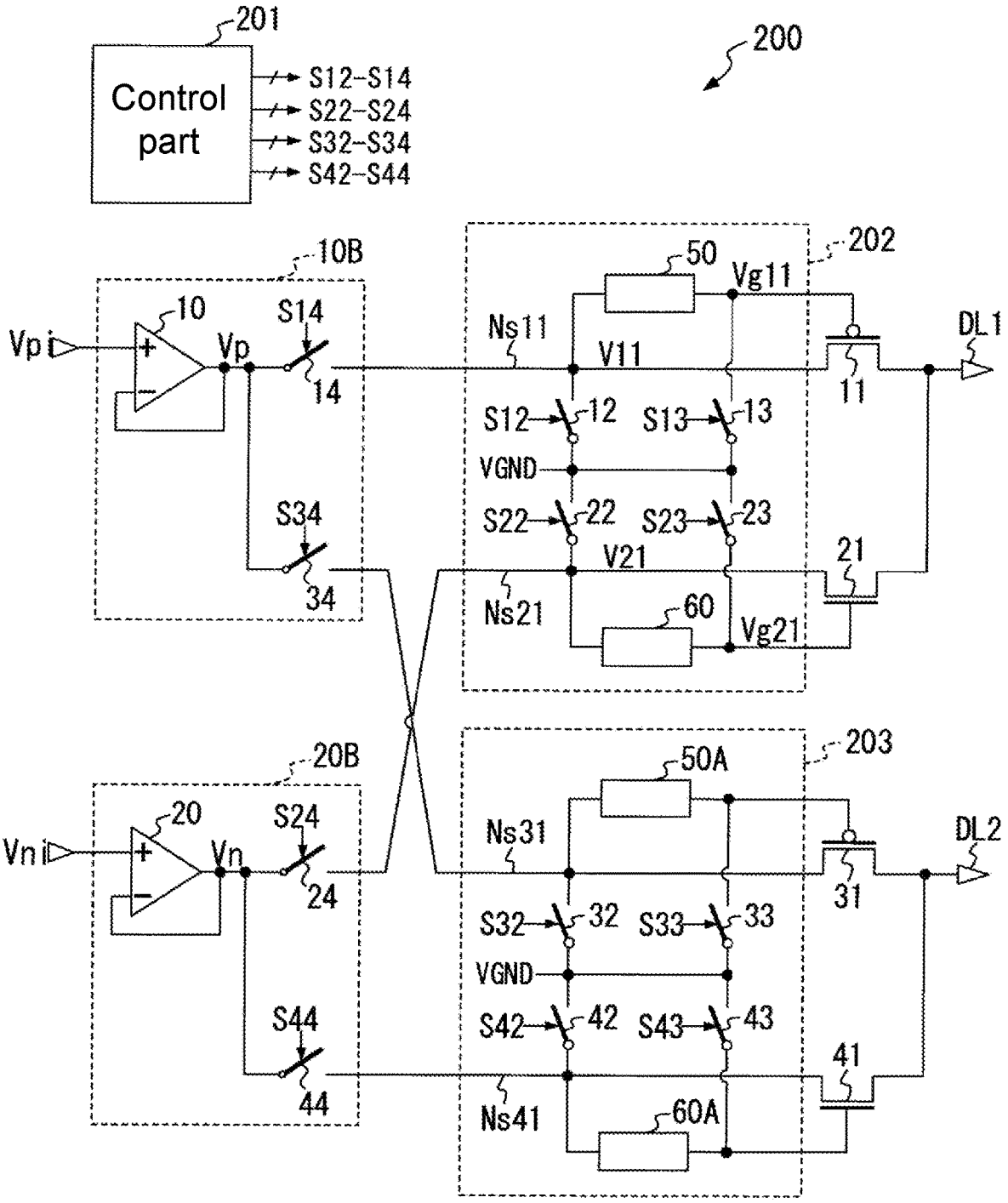
FIG. 9 is a circuit diagram illustrating a configuration of an output circuit 200 as another example of the output circuit according to the present disclosure.

FIG. 9 is a circuit diagram illustrating a configuration of an output circuit 200 as another example of the output circuit according to the present disclosure.

While the output circuit 100 alternately outputs a positive voltage signal and a negative voltage signal to one system of the load, the output circuit 200 illustrated in FIG. 9 outputs a positive voltage signal to one of two systems of load and a negative voltage signal to the other and performs polarity inversion driving of alternately switching the polarity of the signals.

Further, in the output circuit 200 illustrated in FIG. 9, a positive voltage signal supply circuit 10B is employed in place of the positive voltage signal supply circuit 10A illustrated in FIG. 1, a negative voltage signal supply circuit 20B is employed in place of the negative voltage signal supply circuit 20A, and a control part 201 is employed in place of the control part 101. Furthermore, in the output circuit 200 illustrated in FIG. 9, a second output terminal DL2, switches 32 to 34 and 42 to 44, output selection switches 31 and 41, and voltage follower circuits 50A and 60A are newly provided, and other configurations are the same as those illustrated in FIG. 1.

In FIG. 9, the positive voltage signal supply circuit 10B controls supply of a positive voltage signal Vp (VGND<Vp<VDDH) to the node Ns11 or Ns31 of the two systems and cut-off of the supply. The negative voltage signal supply circuit 20B controls supply of a negative voltage signal Vn (VGND>Vn>VDDL) to a node Ns21 or Ns41 of the two systems and cut-off of the supply.

An output selection switch 31 is configured as a P-channel transistor having the source connected to the node Ns31 and the drain connected to the output terminal DL2. An output selection switch 41 is configured as an N-channel transistor having the source connected to the node Ns41 and the drain connected to the output terminal DL2.

The voltage follower circuit 50A is connected between the gate and the source of the output selection switch (P-channel transistor switch) 31 and has the same function as the voltage follower circuit 50. The voltage follower circuit 60A is connected between the gate and the source of the output selection switch (N-channel transistor switch) 41 and has the same function as the voltage follower circuit 60.

The switch 32 is configured as an N-channel transistor connected between the node Ns31 and a reference power supply terminal from which the reference power supply voltage VGND is supplied. The switch 42 is configured as a P-channel transistor connected between the node Ns41 and the reference power supply terminal. The switch 33 is configured as a P-channel transistor connected between the gate of the output selection switch 31 and the reference power supply terminal. The switch 43 is configured as an N-channel transistor connected between the gate of the output selection switch 41 and the reference power supply terminal. Further, the switch 33 can be replaced with a switch connecting the gate of the output selection switch 31 and the node Ns31, and the switch 43 can be replaced with a switch connecting the gate of the output selection switch 41 and the node Ns41.

In FIG. 9, a circuit 202 from the nodes Ns11 and Ns21 to the output terminal DL1 and a circuit 203 from the nodes Ns31 and Ns41 to the output terminal DL2 have the same function as each other, and when one of the circuits performs an operation of outputting a positive voltage signal, the other performs an operation of outputting a negative voltage signal.

The positive voltage signal supply circuit 10B illustrated in FIG. 9 has a configuration in which the switch 34 that controls supply of the positive voltage signal Vp to the node Ns31 and cut-off of the supply is added to the positive voltage signal supply circuit 10A illustrated in FIG. 1. Because the switch 34 also allows the positive voltage signal Vp in a wide voltage range to pass therethrough, it is configured as a complementary switch like the switch 14.

Further, an amplifying circuit 10 included in the positive voltage signal supply circuit 10B may be configured to include the functions of the switches 14 and 34.

The negative voltage signal supply circuit 20B has a configuration in which the switch 44 that controls supply of the negative voltage signal Vn to the node Ns41 and cut-off of the supply is added to the negative voltage signal supply circuit 20A illustrated in FIG. 1. Because the switch 44 also allows the negative voltage signal Vn in a wide voltage range to pass therethrough, it is configured as a complementary switch like the switch 24. Further, an amplifying circuit 20 included in the negative voltage signal supply circuit 20B may be configured to include the functions of the switches 24 and 44.

When the positive voltage signal Vp is output to the output terminal DL1 in the output circuit 200 illustrated in FIG. 9, each of the switches 12 to 14 and 22 to 24 for controlling output to the output terminal DL1 is controlled such that it is turned on and off as in the positive drive period T2 of FIG. 8 (including the switching periods before and after the period). At this time, each of the switches 32 to 34 and 42 to 44 for controlling output to the output terminal DL2 is controlled similarly to the control over the switches 12 to 14 and 22 to 24 in the negative drive period T4 (including the switching periods before and after the period), and thus the negative voltage signal Vn is output to the output terminal DL2.

On the other hand, when the negative voltage signal Vn is output to the output terminal DL1, each of the switches 12 to 14 and 22 to 24 for controlling output to the output terminal DL1 is controlled such that it is turned on and off as in the negative drive period T4 of FIG. 8 (including the switching periods before and after the period). At this time, each of the switches 32 to 34 and 42 to 44 for controlling output to the output terminal DL2 is controlled similarly to the control over the switches 12 to 14 and 22 to 24 in the positive drive period T2 (including the switching periods before and after the period), and thus the positive voltage signal Vp is output to the output terminal DL2.

The control part 201 generates the control signals S11 to S13 and S22 to S24 at the timings shown in FIG. 8, like the control part 101 illustrated in FIG. 1. Furthermore, the control part 201 generates control signals S32 to S34 and S42 to S44 in the above-described signal forms. Further, in a case in which each of the switches 14, 24, 34, and 44 is configured as a complementary switch, complementary signals of the control signals S14, S24, S34 and S44 are generated by the control part 201 as well.

The drive control illustrated in FIG. 8 is performed also on the output circuit 200 illustrated in FIG. 9 as described above, in the same manner as in the output circuit 100. However, with respect to the drive control illustrated in FIG. 8 applied to the output terminal DL2, the supply periods of the positive voltage signal Vp is switched with the supply periods of the negative voltage signal Vn. In other words, the negative voltage signal Vn is supplied to the output terminal DL2 when the positive voltage signal Vp is supplied to the output terminal DL1, and the positive voltage signal Vp is supplied to the output terminal DL2 when the negative voltage signal Vn is supplied to the output terminal DL1.

Further, elements of the output circuit 200 illustrated in FIG. 9 can be configured as low-withstanding voltage elements, like those of the output circuit 100. Therefore, reduced area and costs can be achieved in the output circuit.

Example 9

Figure 10:
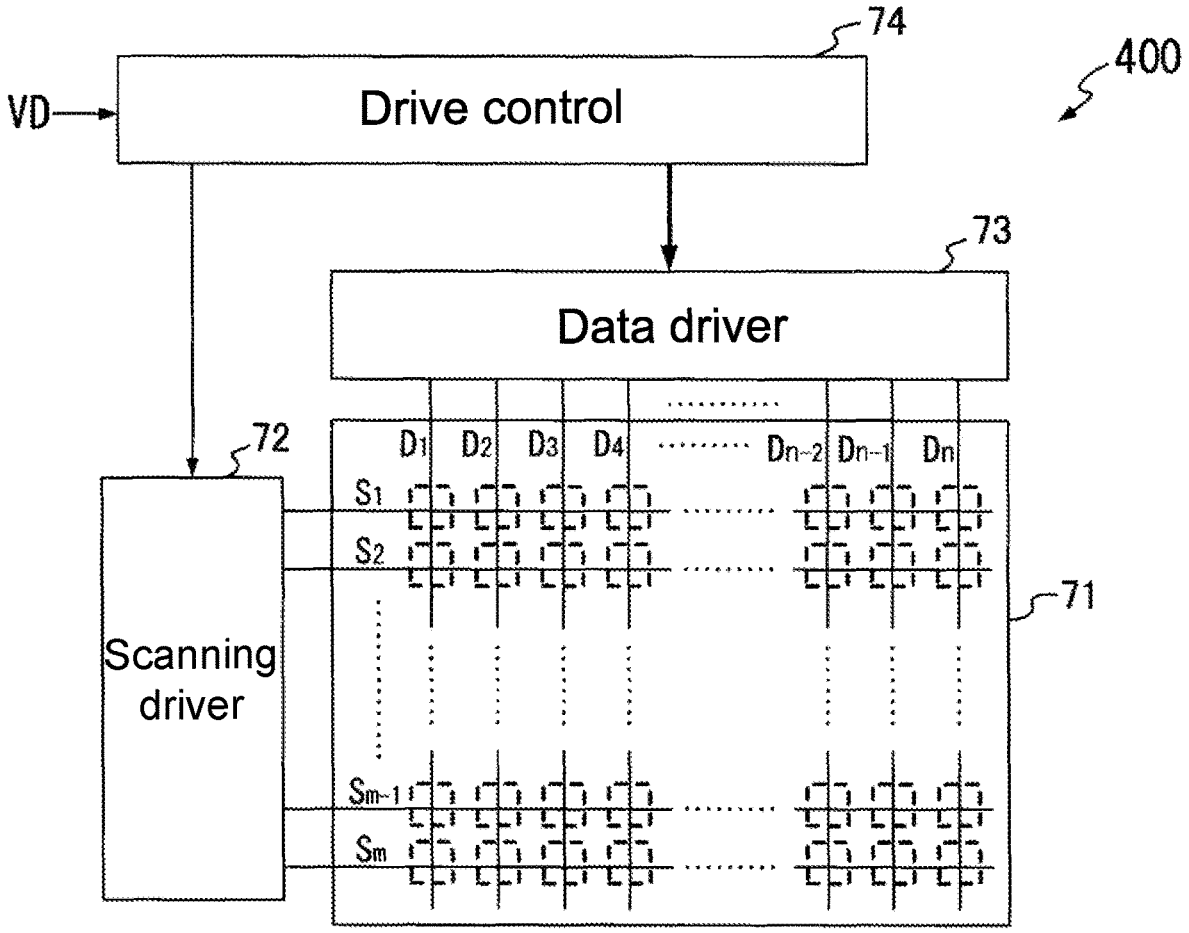
FIG. 10 is a block diagram illustrating a configuration of a display apparatus 400 with a data driver 73 including the output circuit according to the present disclosure.

FIG. 10 is a block diagram illustrating a schematic configuration of a liquid crystal display apparatus 400 with a data driver 73 including the output circuit according to the present disclosure.

In FIG. 10, m (m is a natural number equal to or greater than 2) horizontal scanning lines S1 to Sm extending in the horizontal direction of a two-dimensional screen and n (n is a natural number equal to or greater than 2) data lines D1 to Dn extending in the vertical direction on the two-dimensional screen are formed on an active matrix display panel 71 including liquid crystal display (LCD) devices in units of pixels. Display cells serving as pixels are formed at each intersection of the horizontal scanning lines and data lines. The display cells include at least switching elements and pixel electrodes, and when the switching elements are in the ON state according to a scanning pulse of the horizontal scanning lines, a gradation voltage signal of the data lines is applied to the pixel electrodes via the switching elements, and thereby luminance of the LCD devices is controlled according to the gradation voltage applied to the pixel electrodes. Further, in FIG. 10, a detailed configuration of the display cells is omitted.

A drive control part 74 receives a video signal VD integrated with a control signal, and the like, generates a timing signal based on a horizontal synchronization signal from the video signal VD, and supplies the timing signal to a scanning driver 72. In addition, the drive control part 74 generates a group of various control signals based on the video signal VD and a system of pixel data PD indicating a luminance level of each pixel with, for example, an 8-bit luminance gradation, and supplies them to the data driver 73.

The scanning driver 72 sequentially applies horizontal scanning pulses to each of the horizontal scanning lines S1 to Sm of the display panel 71 based on the timing signals supplied from the drive control part 74.

The data driver 73 is formed in a semiconductor device, for example, a large-scale integrated circuit (LSI). The data driver 73 converts the pixel data PD supplied from the drive control part 74 into gradation voltage signals G1 to Gn having a gradation voltage according to each piece of the pixel data PD for one horizontal scanning line, that is, for every n lines. Then, the data driver 73 applies the gradation voltage signals G1 to Gn to the data lines D1 to Dn of the display panel 71. Further, the scanning driver 72 or the data driver 73 may be formed to be partly or entirely integrated with the display panel in the circuit. In addition, the data driver 73 may be configured with multiple LSIs.

Figure 11:
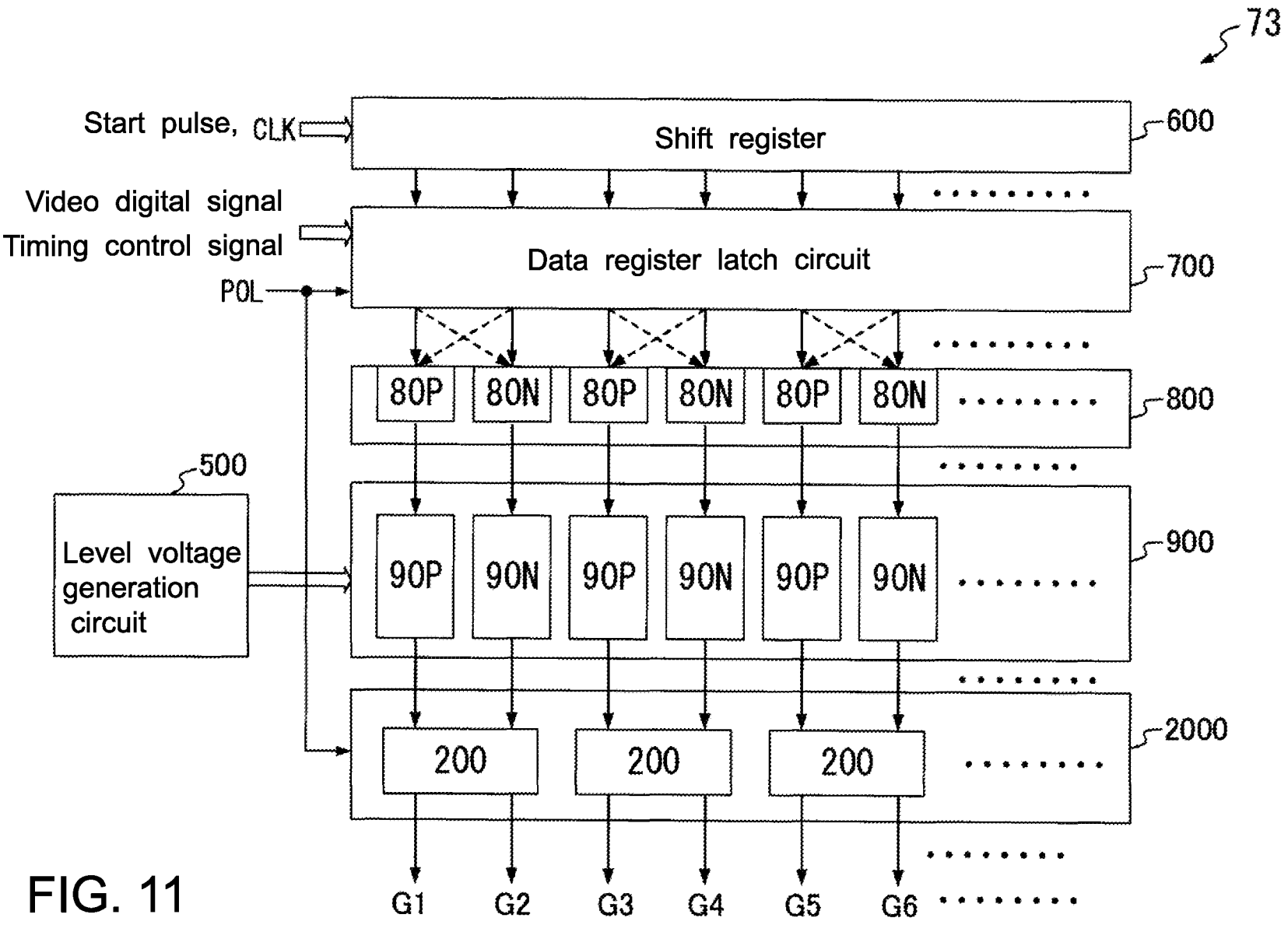
FIG. 11 is a block diagram illustrating an internal configuration of the data driver 73.

FIG. 11 is a block diagram illustrating an internal configuration of the data driver 73.

The data driver 73 includes a shift register 600, a data register latch circuit 700, a level shifter circuit 800, a level voltage generation circuit 500, a decoder circuit 900, and an output amplifying circuit 2000 as illustrated in FIG. 11. In addition, the data driver also includes an interface circuit (not illustrated) that receives a control signal and a video digital signal supplied from the drive control part 74 of FIG. 10 to generate a clock signal and a control signal necessary in the inside of the driver and outputs a group of signals that have been adjusted for timings with the video digital signals. The interface circuit will not be described in detail in FIG. 11 for convenience of explanation. Further, for power supply voltages, at least a reference power supply voltage VGND and a positive low power supply voltage VCCH are supplied to the shift register 600 and the data register latch circuit 700, and a negative low power supply voltage VCCL is also supplied to the block that generates a negative-side signal. At least the reference power supply voltage VGND, a positive power supply voltage VDDH, and a negative power supply voltage VDDL are supplied to the level shifter circuit 800, the level voltage generation circuit 500, the decoder circuit 900, and the output amplifying circuit 2000.

The shift register 600 generates multiple latch timing signals for selecting a latch in synchronization with a clock signal CLK according to a start pulse and supplies the latch timing signals to the data register latch circuit 700.

The data register latch circuit 700 receives video digital signals, polarity inversion signals (POL), and timing control signals, extracts the video digital signals by a predetermined number based on each of the latch timing signals supplied from the shift register 600, and supplies the predetermined number of video digital signals to the level shifter circuit 800 at latch timings.

Further, the data register latch circuit 700 selects video digital signals and output them to level shifters 80P or 80N corresponding to positive or negative based on the polarity inversion signals (POL).

The level shifter circuit 800 includes positive level shifters 80P and negative level shifters 80N. The positive level shifters 80P convert low-amplitude (VGND/VCCH) video digital signals into analog voltage-amplitude (VGND/VDDH) positive video digital signals. The negative level shifters 80N convert low-amplitude (VGND/VCCL) video digital signals into analog voltage-amplitude (VGND/VDDL) negative video digital signals. A predetermined number of video digital data signals supplied from the data register latch circuit 700 are sent to the positive level shifter 80P or the negative level shifter 80N according to the polarity inversion signal (POL), amplified to have the analog-voltage amplitude corresponding to the polarity, and sent to positive decoders 90P or negative decoders 90N.

The decoder circuit 900 is configured by pairs of the positive decoders 90P and negative decoders 90N for each two outputs. Further, the disposition order of the decoders 90P and 90N for the polarities in the decoder circuit 900 can be changed.

The level voltage generation circuit 500 generates multiple level voltages having different voltage values for positive and negative polarities and supplies the voltages to the decoders 90P and 90N.

The decoder circuit 900 selects a level voltage corresponding to a video digital signal that has been processed for level shifting from the above-described multiple level voltages in units of the two outputs of the pairs of the positive decoders 90P and the negative decoders 90N, and supplies the selected level voltage for each polarity to the output amplifying circuit 2000.

The output amplifying circuit 2000 is configured as, for example, the output circuit 200 illustrated in FIG. 9. The output amplifying circuit 2000 receives polarity inversion signals (POL) and a switch control signal group, calculates and amplifies each level voltage with the polarity selected by the decoder circuit 900, and outputs positive voltage signals (Vp) to one of the two output terminals of the data driver and negative voltage signals (Vn) to the other terminal according to the polarity inversion signals (POL). Further, in the output amplifying circuit 2000, for example, the control signals S12 to S14, S22 to S24, S32 to S34, and S42 to S44 of the output circuit 200 of FIG. 9 are controlled according to the polarity inversion signals (POL), and thus the switches 12 to 14, 22 to 24, 32, to 34, and 42 to 44 are controlled such that they are turned on and off. Further, the control part 201 that generates each control signal of FIG. 9 may be commonly provided in multiple output circuit 200 of the output amplifying circuits 2000.

In the block diagram of the data driver in FIG. 11, blocks having a voltage range of analog voltage amplitude are the level shifter circuit 800, the decoder circuit 900, the output amplifying circuit 2000, and the level voltage generation circuit 500.

In addition, the level voltage generation circuit 500 can be configured to have divided ranges of a positive analog voltage range (VGND to VDDH) and a negative analog voltage range (VGND to VDDL). The output amplifying circuit 2000 can be configured with elements with withstanding voltages in the positive analog voltage range (VGND to VDDH) and the negative analog voltage range (VGND to VDDL).

In other words, although the data driver of FIG. 11 outputs liquid crystal drive voltage signals in the voltage range from VDDL to VDDH of the negative voltage signal and the positive voltage signal to the output terminal, the elements consisting the data driver can be elements having the low withstanding voltage VDDT operable in the positive analog voltage range (VGND to VDDH) or the negative analog voltage range (VGND to VDDL) that is half of the liquid crystal drive voltage range. In a case of a transistor with a low withstanding voltage VDDT, for example, the gate insulating film can be made thin, and an output circuit configured with such transistors can have a reduced area. In addition, element spacing can be narrowed by lowering withstanding voltages. Because the data driver of FIG. 11 is configured in a reduced area as described above, low-pricing can be realized.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An output circuit comprising:

a positive voltage signal supply circuit configured to supply a positive voltage signal having a higher voltage than a reference power supply voltage to a first node or to cut off supply of the positive voltage signal to the first node;

a negative voltage signal supply circuit configured to supply a negative voltage signal having a lower voltage than the reference power supply voltage to a second node or to cut off supply of the negative voltage signal to the second node;

a first output terminal;

a first switch configured to be a first P-channel transistor switch with a source connected to the first node and a drain connected to the first output terminal, to connect the first output terminal to the first node when in an ON state, and to cut off connection of the first output terminal to the first node when in an OFF state;

a second switch configured to be a first N-channel transistor switch with a source connected to the second node and a drain connected to the first output terminal, to connect the first output terminal to the second node when in an ON state, and to cut off connection of the first output terminal to the second node when in an OFF state;

a third switch configured to apply the reference power supply voltage to the first node when in an ON state and to stop application of the reference power supply voltage to the first node when in an OFF state;

a fourth switch configured to apply the reference power supply voltage to the second node when in an ON state and to stop application of the reference power supply voltage to the second node when in an OFF state;

a first voltage follower circuit configured to be connected to the first switch and the first node and to control the ON state of the first switch;

a second voltage follower circuit configured to be connected to the second switch and the second node and to control the ON state of the second switch;

a first control switch which, when active, controls the OFF state of the first switch; and a second control switch which, when active, controls the OFF state of the second switch, wherein the first voltage follower circuit includes a first load element connected between the source and a gate of the first switch and a first current source having one end connected to the gate of the first switch and the first load element, the first current source generating a current flowing to the first load element, and the first voltage follower circuit supplies a voltage obtained by shifting a voltage of the positive voltage signal supplied to the first node to a negative side by a predetermined voltage difference to the gate of the first switch, and wherein the second voltage follower circuit includes a second load element connected between the source and a gate of the second switch and a second current source having one end connected to the gate of the second switch and the second load element, the second current source generating a current flowing to the second load element, and the second voltage follower circuit supplies a voltage obtained by shifting a voltage of the negative voltage signal supplied to the second node to a positive side by a predetermined voltage difference to the gate of the second switch.

2. The output circuit according to claim 1, wherein the first control switch is controlled for activation in conjunction with control of the ON state of the third switch and, when active, performs control such that the first switch is brought into the OFF state by supplying the reference power supply voltage to the gate of the first switch, and wherein the second control switch is controlled for activation in conjunction with control of the ON state of the fourth switch and, when active, performs control such that the second switch is brought into the OFF state by supplying the reference power supply voltage to the gate of the second switch.

3. The output circuit according to claim 2, wherein the first current source generates a sink current which flows from the source of the first switch to the gate of the first switch via the first load element, wherein the second current source generates a source current which flows from the gate of the second switch to the source of the second switch via the second load element, wherein the first voltage follower circuit further includes a third current source with one end connected to the source of the first switch, the third current source generating a source current which has a same current value as the first current source and flows to the source of the first switch, and wherein the second voltage follower circuit further includes a fourth current source with one end connected to the source of the second switch, the fourth current source generating a sink current which has a same current value as the second current source and flows from the source of the second switch.

4. The output circuit according to claim 2, wherein the first load element includes a first diode-connected transistor group including N (N≥1) transistors each of which is of a same conductive type and is diode-connected, and wherein the second load element includes a second diode-connected transistor group including M (M≥1) transistors each of which is of a same conductive type and is diode-connected.

5. The output circuit according to claim 2, wherein the first load element includes a first resistive element group including N (N≥1) resistive elements connected between the gate and the source of the first switch, and wherein the second load element includes a second resistive element group including M (M≥1) resistive elements connected between the gate and the source of the second switch.

6. The output circuit according to claim 1, wherein the first current source generates a sink current which flows from the source of the first switch to the gate of the first switch via the first load element, wherein the second current source generates a source current which flows from the gate of the second switch to the source of the second switch via the second load element, wherein the first voltage follower circuit further includes a third current source with one end connected to the source of the first switch, the third current source generating a source current which has a same current value as the first current source and flows to the source of the first switch, and wherein the second voltage follower circuit further includes a fourth current source with one end connected to the source of the second switch, the fourth current source generating a sink current which has a same current value as the second current source and flows from the source of the second switch.

7. The output circuit according to claim 6, wherein the first load element includes a first diode-connected transistor group including N (N≥1) transistors each of which is of a same conductive type and is diode-connected, and wherein the second load element includes a second diode-connected transistor group including M (M≥1) transistors each of which is of a same conductive type and is diode-connected.

8. The output circuit according to claim 6, wherein the first load element includes a first resistive element group including N (N≥1) resistive elements connected between the gate and the source of the first switch, and wherein the second load element includes a second resistive element group including M (M≥1) resistive elements connected between the gate and the source of the second switch.

9. The output circuit according to claim 1, wherein the first load element includes a first diode-connected transistor group including N (N≥1) transistors each of which is of a same conductive type and is diode-connected, and wherein the second load element includes a second diode-connected transistor group including M (M≥1) transistors each of which is of a same conductive type and is diode-connected.

10. The output circuit according to claim 9, wherein the first voltage follower circuit further includes a first voltage difference adjustment section that controls activation and deactivation of the N transistors individually and adjusts the predetermined voltage difference set between the gate and the source of the first switch according to a number of activated transistors, and wherein the second voltage follower circuit further includes a second voltage difference adjustment section that controls activation and deactivation of the M transistors individually and adjusts the predetermined voltage difference set between the gate and the source of the second switch according to a number of activated transistors.

11. The output circuit according to claim 1, wherein the first load element includes a first resistive element group including N (N≥1) resistive elements connected between the gate and the source of the first switch, and wherein the second load element includes a second resistive element group including M (M≥1) resistive elements connected between the gate and the source of the second switch.

12. The output circuit according to claim 11, wherein the first voltage follower circuit further includes a first voltage difference adjustment section that controls activation and deactivation of each resistive element of the first resistive element group individually and adjusts the predetermined voltage difference set between the gate and the source of the first switch according to a number of activated resistive elements, and wherein the second voltage follower circuit further includes a second voltage difference adjustment section that controls activation and deactivation of each resistive element of the second resistive element group individually and adjusts the predetermined voltage difference set between the gate and the source of the second switch according to a number of activated resistive elements.

13. The output circuit according to claim 1, comprising:

a signal control circuit configured to control the positive voltage signal supply circuit, the negative voltage signal supply circuit, the third switch, the fourth switch, the first control switch, and the second control switch in conjunction with each other such that the positive voltage signal and the negative voltage signal are switched at a predetermined timing and output from the first output terminal.

14. The output circuit according to claim 13, wherein, when the positive voltage signal is to be output from the first output terminal, the signal control circuit performs control such that the third switch is in the OFF state, the fourth switch is in the ON state, the first control switch is in an inactive state, and the second control switch is in an active state, and controls the positive voltage signal supply circuit such that the positive voltage signal is supplied to the first node, and controls the negative voltage signal supply circuit such that supply of the negative voltage signal to the second node is cut off, and wherein, when the negative voltage signal is to be output from the first output terminal, the signal control circuit performs control such that the third switch is in the ON state, the fourth switch is in the OFF state, the first control switch is in an active state, and the second control switch is in an inactive state, and controls the negative voltage signal supply circuit such that the negative voltage signal is supplied to the second node, and controls the positive voltage signal supply circuit such that supply of the positive voltage signal to the first node is cut off.

15. The output circuit according to claim 13, wherein the signal control circuit has, as control periods, a first period for preparing for switching from an output of the negative voltage signal to an output of the positive voltage signal, a second period in which the positive voltage signal is output from the first output terminal, a third period for preparing for switching from an output of the positive voltage signal to an output of the negative voltage signal, and a fourth period in which the negative voltage signal is output from the first output terminal, wherein, in the first period and the third period, supply of the positive voltage signal by the positive voltage signal supply circuit is cut off and supply of the negative voltage signal by the negative voltage signal supply circuit is cut off, the third switch and the fourth switch are both controlled to the ON state, the first control switch and the second control switch control at least one of the first switch and the second switch to the ON state, and as a result, the reference power supply voltage is supplied to the first node, the second node, and the first output terminal, wherein, in the second period, supply of the negative voltage signal by the negative voltage signal supply circuit is cut off and the positive voltage signal is supplied to the first node by the positive voltage signal supply circuit, control is performed such that the third switch is in the OFF state, the fourth switch is in the ON state, the first control switch is in an inactive state, and the second control switch is in an active state, and as a result, the positive voltage signal is supplied to the first output terminal via the first switch and the reference power supply voltage is supplied to the second node via the fourth switch, and wherein, in the fourth period, supply of the positive voltage signal by the positive voltage signal supply circuit is cut off and the negative voltage signal is supplied to the second node by the negative voltage signal supply circuit, control is performed such that the third switch is in the ON state, the fourth switch is in the OFF state, the first control switch is in an active state, and the second control switch is in an inactive state, and as a result, the negative voltage signal is supplied to the first output terminal via the second switch and the reference power supply voltage is supplied to the first node via the third switch.

16. The output circuit according to claim 1, further comprising:

a second output terminal;

a third node and a fourth node;

a fifth switch configured to connect the second output terminal to the third node when in an ON state and to cut off connection of the second output terminal to the third node when in an OFF state;

a sixth switch configured to connect the second output tell Anal to the fourth node when in an ON state and to cut off connection of the second output terminal to the fourth node when in an OFF state;

a seventh switch configured to apply the reference power supply voltage to the third node when in an ON state and to stop application of the reference power supply voltage to the third node when in an OFF state;

an eighth switch configured to apply the reference power supply voltage to the fourth node when in an ON state and to stop application of the reference power supply voltage to the fourth node when in an OFF state;

a third voltage follower circuit configured to be connected between the fifth switch and the third node and to control the ON state of the fifth switch;

a fourth voltage follower circuit configured to be connected between the sixth switch and the fourth node and to control the ON state of the sixth switch;

a third control section configured to control the OFF state of the fifth switch; and a fourth control section configured to control the OFF state of the sixth switch, wherein the positive voltage signal supply circuit controls supply of the positive voltage signal to the first node or the third node or cut-off of the supply, wherein the negative voltage signal supply circuit controls supply of the negative voltage signal to the second node or the fourth node or cut-off of the supply, wherein the fifth switch is configured as a second P-channel transistor switch with a source connected to the third node and a drain connected to the second output terminal, wherein the sixth switch is configured as a second N-channel transistor switch with a source connected to the fourth node and a drain connected to the second output terminal, wherein the third voltage follower circuit includes a third load element connected between the source and a gate of the fifth switch and a third current source having one end connected to the gate of the fifth switch and the third load element, the third current source generating a current flowing to the third load element, and the third voltage follower circuit supplies a voltage obtained by shifting a voltage of the positive voltage signal supplied to the third node to a negative side by a predetermined voltage difference to the gate of the fifth switch, and wherein the fourth voltage follower circuit includes a fourth load element connected between the source and a gate of the sixth switch and a fourth current source having one end connected to the gate of the sixth switch and the fourth load element, the fourth current source generating a current flowing to the fourth load element, and the fourth voltage follower circuit supplies a voltage obtained by shifting a voltage of the negative voltage signal supplied to the fourth node to a positive side by a predetermined voltage difference to the gate of the sixth switch.

17. The output circuit according to claim 16, comprising:

a control part configured to control the third switch, the fourth switch, the seventh switch, the eighth switch, the positive voltage signal supply circuit, the negative voltage signal supply circuit, the first control section, the second control section, the third control section, and the fourth control section in conjunction with each other such that one of the positive voltage signal and the negative voltage signal is output from the first output terminal, the other of the positive voltage signal and the negative voltage signal is output from the second output terminal, and a polarity of voltage signal output from each of the first output terminal and the second output terminal is switched at a predetermined timing.

18. The output circuit according to claim 17, wherein, when the positive voltage signal is to be output from the first output terminal and the negative voltage signal is to be output from the second output terminal, the control part performs control such that the third switch and the eighth switch are in the OFF state, the fourth switch and the seventh switch are in the ON state, the first control section and the fourth control section are in an inactive state, and the second control section and the third control section are in an active state, controls the positive voltage signal supply circuit such that the positive voltage signal is supplied to the first node, and controls the negative voltage signal supply circuit such that the negative voltage signal is supplied to the fourth node, and wherein, when the negative voltage signal is to be output from the first output terminal and the positive voltage signal is to be output from the second output terminal, the control part performs control such that the third switch and the eighth switch are in the ON state, the fourth switch and the seventh switch are in the OFF state, the first control section and the fourth control section are in an active state, and the second control section and the third control section are in an inactive state, controls the negative voltage signal supply circuit such that the negative voltage signal is supplied to the second node, and controls the positive voltage signal supply circuit such that the positive voltage signal is supplied to the third node.

19. A data driver comprising:

a plurality of the output circuits according to claim 1, wherein a plurality of gradation voltage signals having a positive or negative voltage value for driving a plurality of data lines of a liquid crystal display panel is output from the plurality of output circuits.

20. A display apparatus comprising:

a data driver including a plurality of the output circuits according to claim 1, in which a plurality of gradation voltage signals having a positive or negative voltage value is output from the plurality of output circuits; and a liquid crystal display panel with a plurality of data lines for receiving the plurality of gradation voltage signals.

* * * * *